US007401765B2

(12) United States Patent
Xia et al.

(10) Patent No.: US 7,401,765 B2
(45) Date of Patent: Jul. 22, 2008

(54) WINCHING AND DRAWING MACHINE

(75) Inventors: Desheng Xia, Yamanashi (JP); Takayoshi Nakamura, Yamanashi (JP); Toshiaki Sakai, Yamanashi (JP); Tsukasa Yamaguchi, Yamanashi (JP)

(73) Assignee: Kito Corporation, Yamanashi (JP)

( * ) Notice: Subject to any disclaimer, the term of this patent is extended or adjusted under 35 U.S.C. 154(b) by 427 days.

(21) Appl. No.: 10/503,727

(22) PCT Filed: Jan. 14, 2003

(86) PCT No.: PCT/JP03/00209

§ 371 (c)(1),
(2), (4) Date: Dec. 30, 2004

(87) PCT Pub. No.: WO03/066506

PCT Pub. Date: Aug. 14, 2003

(65) Prior Publication Data

US 2005/0087035 A1 Apr. 28, 2005

(30) Foreign Application Priority Data

| | | |
|---|---|---|
| Feb. 6, 2002 | (JP) | 2002-029925 |
| Feb. 8, 2002 | (JP) | 2002-031767 |
| Oct. 28, 2002 | (JP) | 2002-312681 |
| Jan. 8, 2003 | (JP) | 2003-002306 |
| Jan. 8, 2003 | (JP) | 2003-002317 |

(51) Int. Cl.

| | |
|---|---|
| ***B66D 5/00*** | (2006.01) |
| ***B66D 3/00*** | (2006.01) |
| ***B66D 3/14*** | (2006.01) |

(52) U.S. Cl. ..... 254/352; 254/350; 254/357; 254/369; 254/372

(58) Field of Classification Search ..... 254/342, 254/350, 352, 353, 357, 369, 372
See application file for complete search history.

(56) References Cited

U.S. PATENT DOCUMENTS

| | | | | |
|---|---|---|---|---|
| 4,469,308 | A | 9/1984 | Nakamura et al. | |
| 4,483,519 | A * | 11/1984 | Nakamura | 254/350 |
| 4,512,555 | A * | 4/1985 | Nakamura | 254/350 |
| 5,149,058 | A * | 9/1992 | Nishimura | 254/369 |

(Continued)

FOREIGN PATENT DOCUMENTS

| | | |
|---|---|---|
| JP | 63-3834 | 1/1988 |

(Continued)

*Primary Examiner*—Evan H Langdon
(74) *Attorney, Agent, or Firm*—Wenderoth, Lind & Ponack, L.L.P.

(57) ABSTRACT

A winching and drawing machine comprises a drive shaft for driving a load sheave, a pressure receiving member fitted onto the drive shaft, brake plates installed in contact with the pressure receiving member and fitted onto the drive shaft, a pawl wheel interposed between the brake plates, a drive member screwed on the drive shaft so as to be pressed to and separated from the brake plates, an idler spring installed between the drive shaft and the drive member, and a lever. A stopper engaging with the drive shaft is provided at an end face of the drive member and an idler grip is fixed on an outer face of the stopper 7. Lever latching structure at a drive-shaft end of the winching and drawing machine has a function of adjusting a chain length.

3 Claims, 26 Drawing Sheets

U.S. PATENT DOCUMENTS 5,156,377 A * 10/1992 Nishimura ..... 254/346
5,238,226 A * 8/1993 Nishimura ..... 254/352
5,364,073 A * 11/1994 Sell ..... 254/369
5,566,925 A * 10/1996 Wada et al. ..... 254/358
5,570,872 A * 11/1996 Inoue et al. ..... 254/350
5,647,576 A * 7/1997 Kataoka ..... 254/352
5,769,398 A * 6/1998 Samejima ..... 254/352
6,007,054 A * 12/1999 Kobayasi et al. ..... 254/372
6,406,001 B1 * 6/2002 Wada ..... 254/352

FOREIGN PATENT DOCUMENTS

| | | |
|---|---|---|
| JP | 7-101693 | 4/1995 |
| JP | 8-296717 | 11/1996 |
| JP | 2000-159487 | 6/2000 |
| JP | 2000-169091 | 6/2000 |
| JP | 2001-72384 | 3/2001 |

* cited by examiner

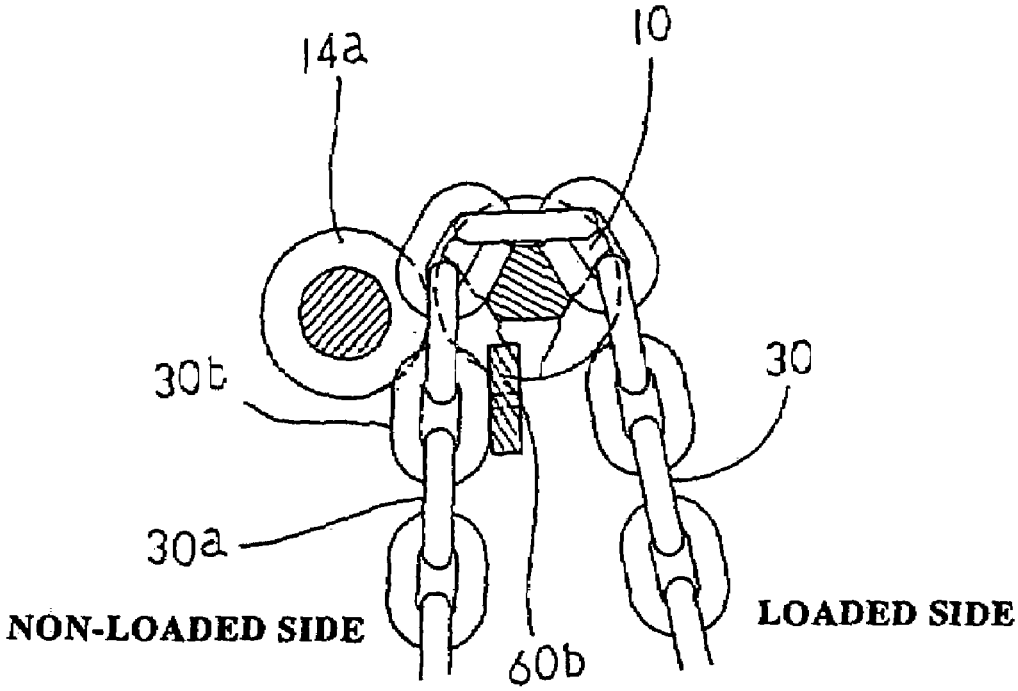
Fig. 22 (a) (Prior Art)
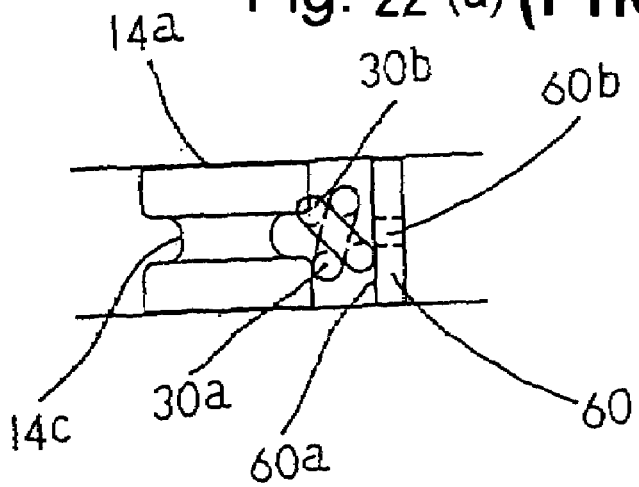
Fig. 22 (b) (Prior Art)

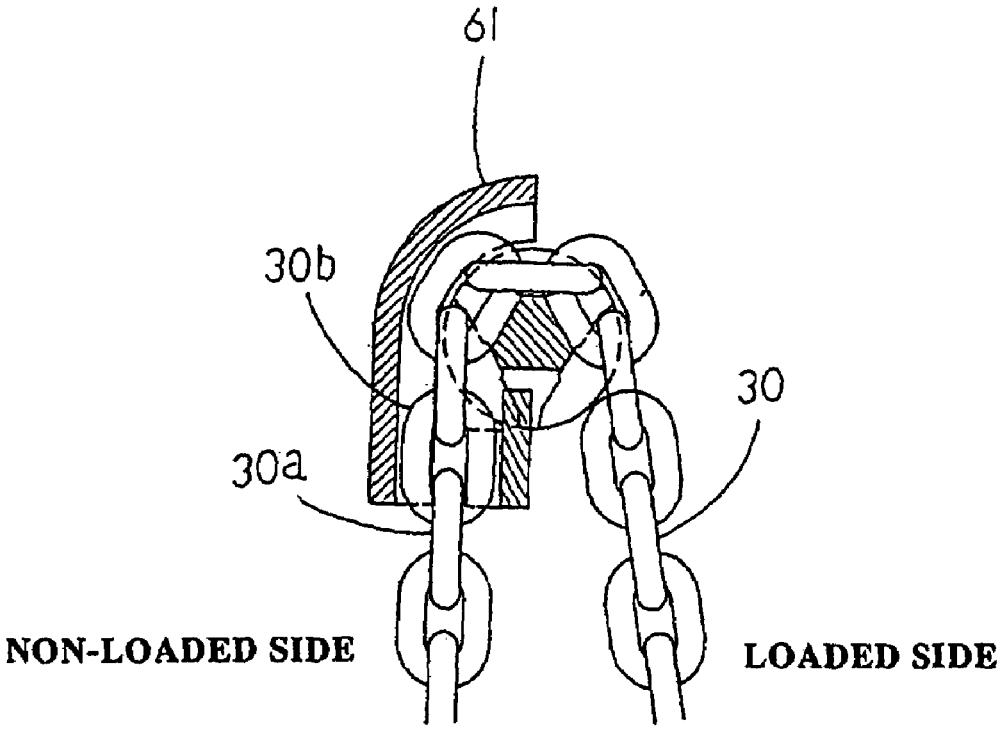
Fig. 23(a) (Prior Art)
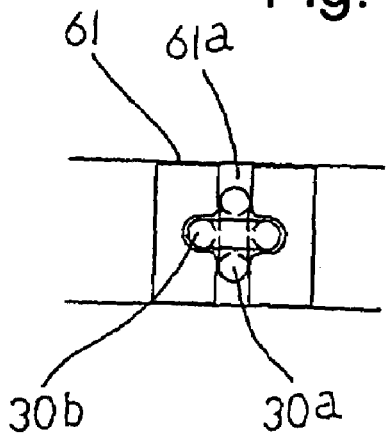
Fig. 23 (b) (Prior Art)

WINCHING AND DRAWING MACHINE

TECHNICAL FIELD

The present invention relates to a winching and drawing machine, and, more particular, to a winching and drawing machine, in which a number of parts is small and which can be made small in size and lightweight.

BACKGROUND ART

Conventionally, several proposals have been made for a winching and drawing machine, in which a number of parts is small and which is relatively simple in construction. A winching and drawing machine shown in FIG. 20, for example, provides an idler grip that adjusts a chain length.

Adjustment of the chain length by use of a conventional idler grip will be described below with reference to FIG. 20.

The winching and drawing machine shown in FIG. 20 comprises a drive member 35 screwed on a drive shaft 31 so as to be able to advance and retreat, an opening 37 through which extends the drive shaft 31 and which is capped, an idler grip 41 provided at an end of the drive shaft 31, a spring 40 installed between the idler grip 41 and the drive shaft 31 to elastically bias the drive member 35 in a direction away from brake plates 33, and a restriction member 39 that restricts rotation of the drive member 35.

In a winching and drawing machine of this type, the idler grip 41 is held by screws against screw holes provided on a projecting portion 38 of the drive member 35, and peripheral concave grooves 36 for mounting of a handle 43 are provided on an outer peripheral surface of the drive member 35 where the drive member 35 contacts the idler grip 41. Also, the restriction member 39 is biased toward a step 31*a* of a male thread portion of the drive shaft 31 by the spring 40 so as not to project from the opening 37 of the drive member 35, and also the drive member 35 is biased by the spring 40 via the idler grip 41 in a direction away from the brake plates 33. Also, a projecting portion 39*a* of the restriction member 39 and the projecting portion 38 of the drive member 35 abut each other to restrict rotation of the drive member 35 relative to the drive shaft 31.

When the winching and drawing machine is operated under a load, the handle 43 is repeatedly swung in a winching-up direction to rotate the drive member 35 whereby torque is transmitted to the drive shaft 31 via the brake plates 33, a brake bearing member 32, and the like to rotate a load sheave in a winching-up direction to winch up a chain.

Also, when the handle 43 is repeatedly swung in a winching-down direction, the chain is winched down and when there is no load, the drive member 35 is released from the brake plates 33 due to action of the spring 40, so that the load sheave, around which the chain is wound, is put in an idling state capable of idling. When a load is applied to the chain during this time of idling, a screwing action generates a pressing force of the drive member 35 on the brake plates 33 to cause a braked state, so that rotation of the load sheave in the winching-down direction is prevented. Also, while adjustment of the chain length at the time of idling can be performed by directly pulling the chain, it can be also performed by turning the idler grip 41 to rotate the drive member 35.

Since the winching and drawing machine described above is provided with the restriction member 39 fitted into a splined portion of the drive shaft 31 in order to restrict rotation of the drive member 35, it is necessary to spline the drive shaft 31 and the restriction member 39, and it is necessary to provide the projection 39*a* on the restriction member 39 and to provide the projection 38, with which the projection 39*a* is to abut, inside of the drive member 35. Further, since the idler grip 41 is screwed against the screw holes provided on the drive member 35, it is necessary to form screw holes on the drive member 35 and the drive member 35 must have a certain degree of thickness in order to have the screw holes possessing strength, so that the drive member 35 is increased in diameter with a result that a fitting opening of the lever 43 becomes large in diameter and causes a disadvantage in that the winching and drawing machine in its entirety must be large in size.

Also, there are known a construction in which a handle is fitted onto a drive member and a retaining washer is provided on an end of a drive shaft where it is latched to a retaining member, and a construction in which a nut is fitted onto an end of a drive shaft and the end of the drive shaft is latched by a retaining pin. However, both such washer and nut are provided to prevent coming-off but do not use an idler grip which would perform adjustment of a chain length so that direct contact with a chain would be unnecessary.

Also, regarding the drive member of a winching and drawing machine, it is conventional that an idler spring is installed on the drive shaft at that side of the drive member on which brake plates are fitted and mounted, and at time a of winching-up operation, a lever handle is repeatedly rotated, thereby moving the drive member against the idler spring toward the brake plates to bring a brake bearing member into pressure contact with a bearing holding stepped portion of the drive shaft to transmit rotation of the drive member to the drive shaft to turn a load sheave. Also, when there is no load, the drive member is biased by the idler spring in a loosening direction and the brake plates or the like are released, so that it is possible to operate the chain freely.

With the winching and drawing machine of the conventional type, since the idler spring has the same diameter where it is mounted on the side toward the drive member and where it is mounted on the side toward the brake plates of the drive shaft, a step having a larger diameter than that of the idler spring is provided on that portion of the drive shaft with which the idler spring engages in order to cause engagement of the idler spring, so that the drive shaft is increased in diameter, parts such as brake plates mounted on the drive shaft, and the like are increased in inside diameter, and respective parts are correspondingly increased in external shape, which is responsible for enlargement of a main body of the winching and drawing machine.

Further, with a conventional winching and drawing machine provided with load-side and non-load side guide rollers that guide a chain wound around a load sheave, these respective guide rollers are independent as single parts from other parts to be mounted on a frame, so that they constitute an obstacle in making a winching and drawing machine small in size and involve a problem in that they are large in weight and expensive.

A construction of guide rollers of a conventional winching and drawing machine will be described below with reference to FIG. 21.

In this figure, reference numeral 50 denotes a load sheave, 51 a pinion gear to mesh with a load gear (not shown), 52*a* a load-side guide roller contacting an outer side of load-side chain and guiding the load-side chain from outside, 52*b* a non-load side guide roller, 53 a frame, 54 a chain, and 55 a drive shaft.

The pinion gear 51 is provided at an end of the drive shaft 55 and driven by known drive structure such as a drive member, brake plates, a brake bearing member, a multiple thread, and the like. When the pinion gear 51 is driven, the load sheave 50 is rotated via a load gear (not shown) which meshes with the pinion gear to winch up the chain 54. When the load sheave 50 operates to winch up the chain 54, the chain 54 is guided by the load-side and non-load side guide rollers 52*a*, 52*b* so that the chain is prevented from detaching from the load sheave 50. In this manner, the guide rollers 52*a*, 52*b* are mounted as single parts on the frame 53.

Further, as structure related to the chain guide, a link chain paid out toward the non-load side from the load sheave has a problem in that at a time of winching-up of the chain, it is sent to the non-load side while still being wound around the load sheave, fitted into the groove of the load sheave. In order to solve the problem, as shown in FIGS. 22(*a*) and 22(*b*), there is known an arrangement described in, for example, JP-A-5-123794, in which a chain guide comprising a non-load side guide 14*a* disposed close to load sheave 10 and having a groove 14*c* for guiding vertical links 30*b*, and an inner guide 60 in the form of a flat plate having a guide plane 60*a* arranged so that link chain 30 is interposed between it and the non-load side guide 14*a* to guide the link chain 30, is provided on a non-load side of the winching and drawing machine, and among links in the non-load side chain 30 paid out from the load sheave 10, transverse links 30*a* fitted into a load sheave groove following vertical links 30*b* are separated from the load sheave groove by projection 60*b*, which is provided on a tip end of the inner guide 60 and pushes out the vertical links 30*b* away from the load sheave, that is, outside the load sheave 10, whereby winding of the transverse links 30*a* around the load sheave is restricted.

When using a chain guide of this type to take an action of winching down a link chain, that is, in a case where the link chain 30 is to be forwarded to a load side from a non-load side, the link chain 30 is forwarded to the load side of the load sheave 10 while the vertical links 30*b* are guided by the groove 14*c* of the non-load side guide 14*a* and restrained by the guide plane 60*a* of the inner guide 60.

However, while an action of forwarding the link chain 30 is smoothly performed in a case where the vertical links 30*b* are forwarded in a state of being fitted into the groove 14*c* of the non-load side guide roller 14*a* at a time of forwarding the link chain 30, there occurs a case where the link chain 30 is twisted as shown in FIG. 22(*b*), whereby the vertical links 30*b* are not fitted into the groove 14*c* of the non-load side guide roller 14*a*, and the link chain 30 is forwarded to the load sheave 10 in a state of being squeezed between the non-load side guide roller 14*a* and the guide plane 60*a* of the inner guide 60. In this case, the link chain 30 is caught by the non-load side guide roller 14*a* between the non-load side guide roller 14*a* and the load sheave 10, so there is no smooth winching action of the link chain by the load sheave 10.

In order to solve this problem, a chain guide has been developed (for example, see JP-A-6-155325), in which a guide member 61 for guiding vertical links 30*b* and transverse links 30*a* with use of a cross-shaped guide 61*a* is provided on a non-load side of a winching and drawing machine as shown in FIGS. 23(*a*) and 23(*b*) to prevent generation of twisting of a link chain 30 at a time of an action of forwarding the link chain 30.

However, the construction described in JP-A-6-155325 involves a problem in that it is complicated in working and parts are high in cost since a guide surface has cross-shaped concavities and an entire construction is one unit.

Next, a load gear and a load sheave are conventionally connected together by use of splines or serrations provided on a sheave shaft as shown in FIGS. 24 and 25.

Conventional connection structure for a load gear and a load sheave will be described below.

In FIGS. 24 and 25, reference numeral 70 denotes a drive shaft, and 70*a* a pinion, with both members, respectively, being supported by bearings. Reference numeral 71 denotes a load sheave, and 72 a sheave shaft provided at an end of the load sheave 71, with both members, respectively, being supported by bearings 75. Reference numeral 73 denotes a load gear connected to the sheave shaft by use of splines orserrations, with the load gear meshing with the pinion 70*a* to transmit rotation of the drive shaft 70 to the load sheave 71 to rotate the load sheave 71. The pinion 70*a*, the load gear 73, and the sheave shaft 72 are covered by a gear casing 74. The sheave shaft 72 of the load sheave 71 is provided, as shown in FIG. 25, with splines 72*d* with which the load gear 73 meshes. Such structure is known in JP-B-63-3834.

Since working of grooves for the splines 72*d* is performed by cutting/rolling, it is necessary to provide on the sheave shaft 72 a relief area where a cutting tool can extend safely. Therefore, the conventional sheave shaft 72 needs a relief 72*e*, which is disposed between an end of the splines 72*d* and a front face 72*c* of the sheave shaft 72 as shown in FIGS. 24 and 25. The relief 72*e* does not function for fitting of the load gear 73 directly, so that the load gear becomes wider by a width of the relief 72*e*, and the pinion which meshes with the load gear 73, reduction gears, and the like are also increased in thickness, which leads to an increase in width of the winching and drawing machine and constitutes an obstacle in making the winching and drawing machine small in size and lightweight. Also, since working of grooves for the splines is performed by cutting/rolling as described above, there is caused a problem in that working is increased in cost and number of steps.

Also, since a body frame of a winching and drawing machine is conventionally fixed by bolts and nuts, steps for assembly are increased to cause an obstacle in miniaturization. Conventional fixation structure for a body frame will be described below with reference to FIG. 26.

In FIG. 26, a load sheave 89 is provided between a pair of frames 84 that are positioned by steps of a bolt 85 to keep a predetermined spacing therebetween, small-diameter portions at both ends of the bolt 85 are fitted and inserted into holes provided on the frames 84, and the small-diameter portions at the both ends are threaded and clamped by nuts 86.

Brake plates 87, and a brake bearing member 88 are covered by a brake cover 83, and an outside of the frame 84 toward the load sheave 89 is covered by a cover 82.

With this conventional winching and drawing machine, the small-diameter portions at both ends of the bolt 85 are fitted and inserted into the holes provided on the frames 84 and the holes provided on the frames 84 are set to be slightly larger in diameter than the threaded portions at both ends of the bolt 85 so as to allow threaded portions at the both ends to go through the holes. Therefore, there are slight gaps between the threaded portions at both ends of the bolt 85 and the holes of the frames 84 even when the bolt 85 is clamped by the nuts 86 and the frames 84, the brake cover 83, and the gear casing 82 are fixed together, so that dislocation such as offset, or the like, is in some cases generated corresponding to these gaps in a case where the winching and drawing machine is given a large shock during operation.

Also, since both ends of the bolt 85 are clamped by the nuts, one end of the bolt is given a nut and then the body must be reversed to give the other end of the bolt the other nut, so that more assembly steps are needed for such action. Further, since tip ends of the bolt and the nuts are exposed outside the body, rust is generated and damage is liable to be caused, in which case disassembly for maintenance becomes difficult. Also, there is a need of providing a space, which allows motion of a nut mounting tool such as spanner, or the like for screwing the nut, on the brake cover 83 and the gear casing 82, which constitutes an obstacle to miniaturization.

In view of respective problems described above, the invention provides a winching and drawing machine, of which miniaturization and lightening are achieved and which is durable and easy to assemble and disassemble.

SUMMARY OF THE INVENTION

An idler grip provided at an end of a drive shaft on conventional winching and drawing machines requires forming splines on the drive shaft and a restriction member; the idler grip is screwed to a threaded hole provided on a drive member, and the drive member must be increased in diameter so that holes in the drive member can hold screws, thereby causing a problem in that the winching and drawing machine in its entirety becomes large in size; it is necessary to make a spring-accommodating portion of the drive shaft larger in diameter than an idler spring, so that outer dimensions of these parts become large to make the winching and drawing machine large in size; a guide roller is independent of other parts and is mounted on an axle, so that it constitutes an obstacle to miniaturization; conventional chain guides involve a problem in that working is complicated and parts are expensive; conventional connection structure for connection of a load gear and a load sheave requires a relief for formation of splines, so that the load gear is increased in width to constitute an obstacle to miniaturization and lightening; and fixation of a body frame by bolts and nuts causes a problem in that assembly steps are increased and the winching and drawing machine becomes large in size. The present invention solves these problems and has a first feature in that a stopper is provided on an end surface of a drive member to be mounted on the drive member and to engage with a drive shaft, and an idler grip is fixed to the stopper.

While a winching and drawing machine provided with a conventional idler grip requires a restriction member for restriction of rotation of a drive member, according to the present invention a stopper structured in the manner described above is provided to thereby make unnecessary any restriction member, an idler grip is structured not to be fixed to a drive member, thus eliminating a need of increasing a diameter of the drive member and enabling making a winching and drawing machine small in size and lightweight, and an end face of the handle mounting portion is covered by the idler grip, whereby the winching and drawing machine can have a more graceful appearance than conventional winching and drawing machines.

Further, as compared with a conventional arrangement, in which washers for keeping the drive member and handle from coming off are provided at an end of the drive shaft, a winching and drawing machine having multiple functions can be provided because it is possible to adjust a chain length with the idler grip.

Second, the invention has a feature in that in a winching and drawing machine in which rotation of a drive member is transmitted via brake plates to a drive shaft to rotate a load sheave, an idler spring is smaller in diameter on a side where the brake plates are mounted than on a side toward the drive member, and a small-diameter portion is mounted on a latch portion provided on the side of the drive shaft on which the brake plates are mounted.

According to the invention, an idler spring is smaller in diameter at the side on which the brake plates are mounted than the side toward the drive member, and the small-diameter portion is mounted on a latch portion provided at the side where the brake plates are mounted, so that the drive shaft can be made small in diameter as compared with conventional drive shafts, and parts mounted on the drive shaft can also be made small in diameter, thus enabling providing a winching and drawing machine, which can be made small in size, lightweight and inexpensive.

Third, the invention has a feature in that in a winching and drawing machine including a pinion gear provided on an end of the drive shaft, a load sheave driven via a load gear which interlocks with the pinion gear, and a guide roller for guiding a chain wound around the load sheave, the guide roller is provided to be coaxial with the drive shaft and to contact an exterior of the chain wound around the load sheave.

According to the invention, since the guide roller is provided coaxially with the drive shaft, it is possible to provide a winching and drawing machine in which a number of parts can be decreased, a body of the winching and drawing machine can be made small in size and lightweight, and assembling steps are decreased to lead to a decrease in cost, as compared with conventional winching and drawing machines, in which guide rollers are borne as separate parts by frames.

Fourth, the invention has a feature in that in the winching and drawing machine rotates a load sheave around which a link chain is wound to raise and lower the link chain, an outer guide having a groove for guiding vertical links of the link chain is provided outside the link chain relative to the load sheave where the link chain suspends from the load sheave on a non-load side of the load sheave, and an inner guide having a slope that positions transverse links of the link chain is provided inside the link chain relative to the load sheave.

According to the invention, when a winching-down action of the link chain is taken, the transverse links of the link chain forwarded onto the chain guide are restricted in inclination by the slope of the inner guide, a vertical link forwarded to the chain guide subsequent to a transverse link is also restricted in inclination, and the vertical links are fitted into the groove of the outer guide to be forwarded while assuming a cross pattern together with the transverse links, so that the link chain is not caught by the outer guide, and the winching-down operation can be smoothly performed.

Fifth, the invention has a feature in that in a winching and drawing machine which includes a sheave shaft provided at an end of a load sheave to mount thereon a load gear so that the load sheave is rotated via the load gear, the sheave shaft is provided with grooves which comprise slopes extended longitudinally and oblique to a line toward an axis, and the load gear is provided at an inner peripheral surface thereof with projections that contact slopes of the grooves.

According to the invention, the grooves in place of the conventional splines or the like are provided on the sheave shaft, and the load gear is fittingly mounted on the grooves, whereby relief is not needed for working of the sheave shaft and the machine in its entirety can be made small in size, lightweight, and low in cost; and since the grooves are provided with the slopes which are oblique to the line toward an axis of the sheave shaft, a direction of torque transmission is made circumferential, torque transmission can be smoothly effected, and an excessive load on the sheave shaft can be lessened, so that it is possible to reduce a number of grooves, or make the grooves small in configuration, which greatly facilitates working.

Sixth, the invention is characterized by spacers interposed between the gear casing and the brake cover and comprising steps that abut the frames for positioning, with these spacers having small-diameter portions that are fitted into recesses of the gear casing and the brake cover, and by bolts provided to extend through the brake cover and the gear casing to be fixed thereto, and in that the frames are interposed and fixed between the steps of the spacers and inner end surfaces of the gear casing and the brake cover.

According to the invention, it is possible to provide a compact and precise winching and drawing machine, in which a spacing of the body frames of the winching and drawing machine is prescribed by steps of the spacers, the frames are positioned when clamping is effected by the bolts, the frames are clamped and fixed between the steps provided on the spacers and the inner end surfaces of the gear casing and the brake cover to facilitate positioning of the frames, and when the frames are clamped no clearances are generated between parts, and dislocation such as offset is not generated between the frames and remaining parts.

BRIEF DESCRIPTION OF THE DRAWINGS

FIGS. 22(*a*) and 22(*b*) are schematic views showing prior art corresponding to the third embodiment.

FIGS. 23(*a*) and 23(*b*) are schematic views showing prior art corresponding to the third embodiment.

DETAILED DESCRIPTION OF THE PREFERRED EMBODIMENTS

Figure 1:
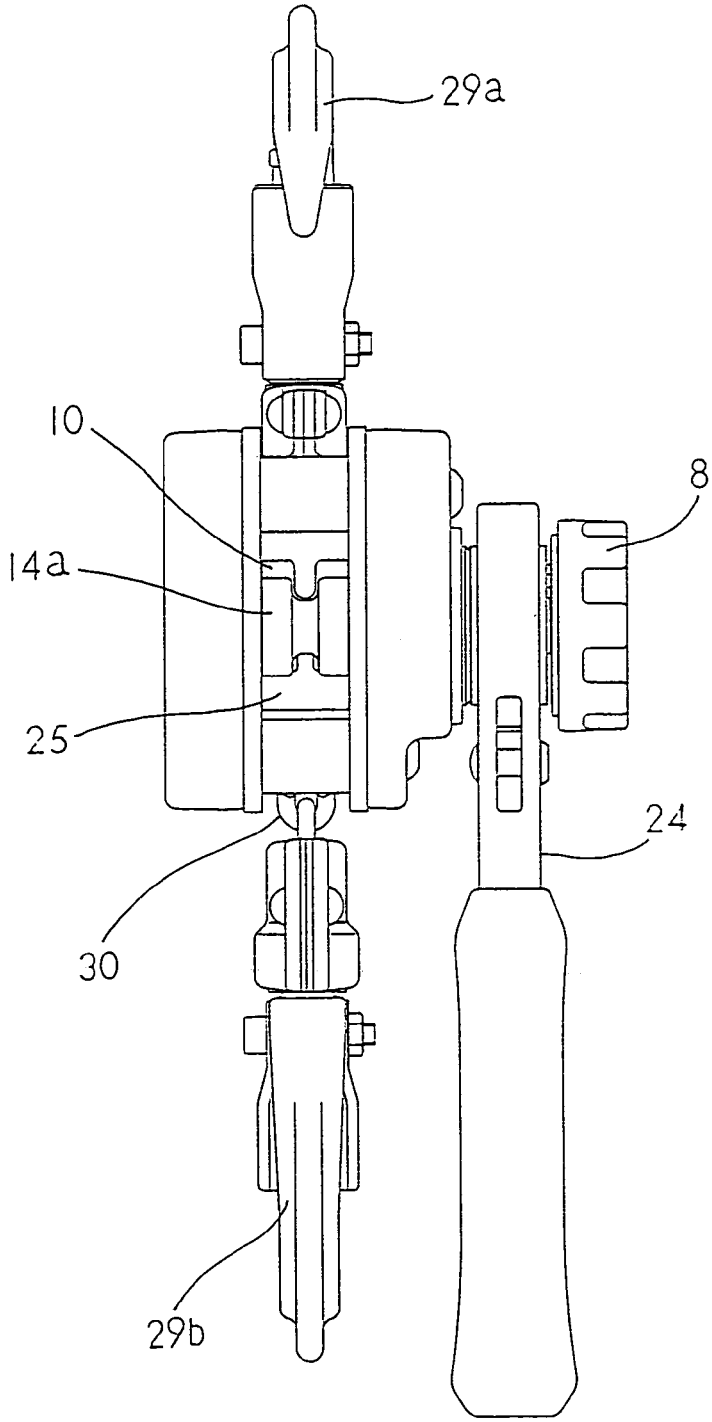
FIG. 1 is a side view showing a winching and drawing machine according to the invention.
Figure 2:
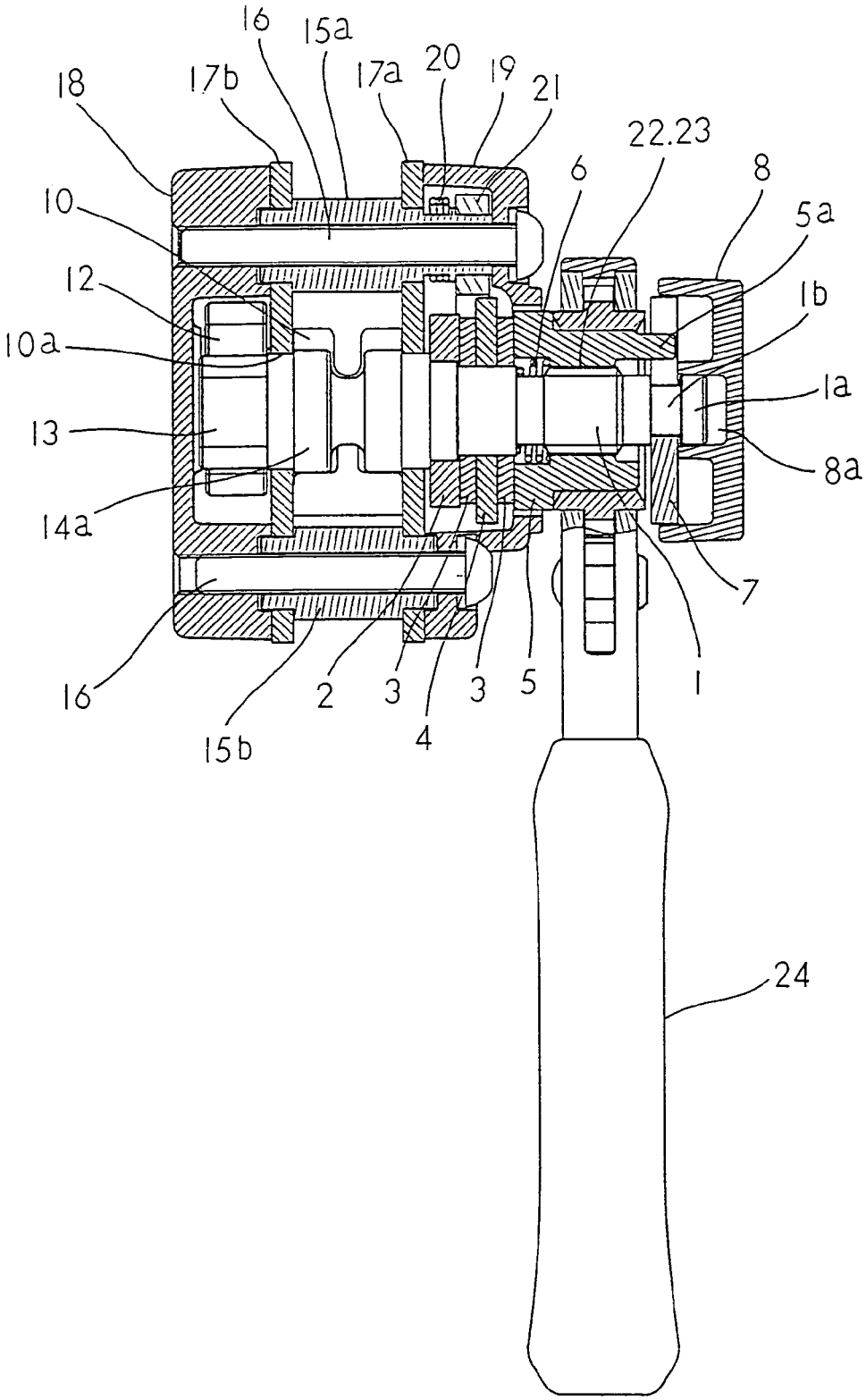
FIG. 2 is a side, cross sectional view showing the winching and drawing machine according to the invention.
Figure 3:
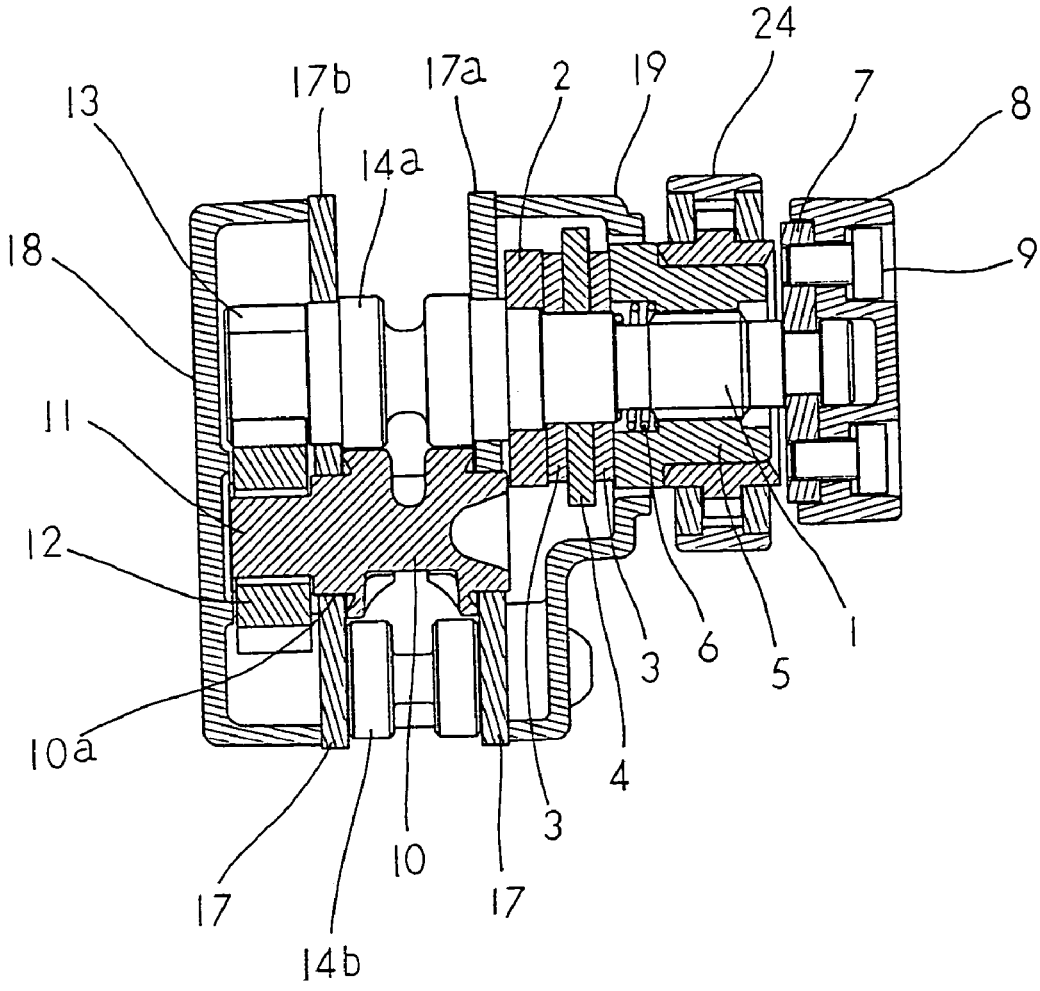
FIG. 3 is a bottom, cross sectional view showing the winching and drawing machine according to the invention.

The invention of the present application has features described above, and an entire constitution of a winching and drawing machine according to the invention will be described with reference to FIGS. 1 to 3. FIG. 1 is a side view showing a winching and drawing machine according to the invention, FIG. 2 is a front view, and FIG. 3 is a bottom view.

In these figures, reference numeral 1 denotes a drive shaft supported on frames 17*a*, 17*b* so as to be rotatable, a brake bearing member 2 is fitted onto the drive shaft 1 on a side toward the frame 17*a* so as to be non-rotatable, a pawl wheel 4 contiguous to the brake bearing member 2 and interposed between a pair of brake plates 3 is fitted onto the drive shaft, and multiple screw threads 22 are provided on an end of the drive shaft to have a drive member 5 screwed thereon. Also, a non-load side guide roller 14*a* is provided between the frames 17*a*, 17*b* on another side of the drive shaft and a pinion gear 13 is provided on an end of the drive shaft. Reference numeral 2 denotes the brake bearing member externally fitted onto the drive shaft 1 so as to be non-rotatable, 4 the pawl wheel externally fitted onto the drive shaft 1, 3 the brake plates externally fitted onto the drive shaft 1 and sandwiching the pawl wheel 4 from right and left, 13 the pinion gear provided on the end of the drive shaft 1, 14*a* the non-load side guide roller integrally and coaxially formed on the drive shaft 1 and provided between the frames 17*a* and 17*b*, 14*b* a load side guide roller supported on a load side between the frames 17*a* and 17*b*, 5 the drive member provided with female threads 23 that mesh with multiple threads 22 of the drive shaft 1, 6 an idler spring mounted between an end of a brake-plate mount portion 1*e* of the drive shaft 1 and an inner step of the drive member 5 to bias the drive member 5 in a direction of loosening, and 22 the multiple threads provided on the drive shaft 2. Reference numeral 7 denotes a stopper mounted on an end of the drive shaft 1, 8 an idler grip fixed on the stopper 7, 12 a load gear to mesh with the pinion gear 13, and 10 a load sheave provided with a sheave shaft 11 onto which the load gear 12 is externally fitted, with the load sheave being rotatably supported by the sheave shaft between the frames 17*a*, 17*b*. The drive member 5 is screwed to the multiple threads 22 provided on an end of the drive shaft 1, and is pushed and advanced by turning a lever 24 fitted onto an outer periphery of the drive member to bring the brake bearing member 2 into pressure contact with a bearing step of the drive shaft 1 via the brake plates 3 and thus apply rotation to the drive shaft.

The non-load side guide roller 14*a* is provided between the frames 17*a* and 17*b* on the other end of the drive shaft 1, and the pinion gear 13 is projected outside the support frame 17*b* to mesh with the load gear 12 externally fitted onto the sheave shaft 11 of the load sheave 10. In addition, the load side guide roller 14*b* is supported by the frames 17*a*, 17*b* to be disposed opposite from the non-load side guide roller 14*a* with respect to the load sheave 10, to guide chain 30. Reference numerals 15*a*, 15*b* denote spacers which prescribe a spacing between the frames 17*a*, 17*b* and are fixed between the frames 17*a*, 17*b*, with one end fitted into the frame 17*b* and a gear cover 18, and another other end fitted into the frame 17*a* and a brake cover 19. Reference numeral 16 denotes bolts fittingly inserted into hollow spacers 15*a*, 15*b* from bolt insertion holes provided on the brake cover 19, with ends of the bolts being screwed into the gear cover 18. Reference numeral 21 denotes a reverse-rotation preventive pawl mounted on hollow spacer 15*a*, and 20 a spring, one end of which is latched on the frame 17*a* and another end of which is latched on the reverse-rotation preventive pawl 21 across a flange of the hollow spacer 15*a* to bias the reverse-rotation preventive pawl 21 in a direction in which the reverse-rotation preventive pawl 21 latches on teeth provided on an outer periphery of the pawl wheel 4, with the spring being wound around the hollow spacer 15*a*.

EMBODIMENTS

Next, embodiments of the invention will be described.

First Embodiment

A first embodiment of the invention will be described below with reference to FIGS. 2, 4(*a*), and 4(*b*). In these figures, reference numeral 1*a* denotes a drive-shaft end rotatably supporting the idler grip 8 and having a larger diameter than that of a latch groove 1*b*, 1*b* the latch groove engaging with the stopper to restrict axial movements of the stopper 7, 2 the brake bearing member which is a pressure receiving member, 3 the brake plates, 4 the pawl wheel, 21 the reverse-rotation preventive pawl being latched on the pawl wheel, 5 the drive member, 6 the idler spring, 7 the plate-shaped stopper having a groove 7*c*, into which a projection 5*a* of the drive member 5 is fitted, and a shaft support groove 7*a* to engage with the drive shaft, 7*b* threaded holes, 8 the idler grip, 8*a* a bearing provided inside the idler grip 8, 9 screws, 10 the load sheave around which the chain is wound, 17 a frame, 18 the gear cover, 19 the brake cover, and 24 the lever.

A winching and drawing machine according to the embodiment of the invention comprises the brake bearing member 2 fitted onto the drive shaft 1 to rotate therewith, the pair of brake plates 3 disposed contiguous to the brake bearing member 2 and fitted onto the drive shaft 1, the pawl wheel 4 arranged between the brake plates 3, the drive member 5 screwed on the drive shaft 1 so that the drive shaft 1 can cause the drive member 5 to advance and retreat so as to come into and out of pressure contact with the brake plates 3 to control braking, the idler spring 6 provided between the step of the drive shaft 1 and the inside step of the drive member 5 to bias the drive member 5 in a direction away from the brake plates 3, the stopper 7 acting as a stopper to engage with the latch groove 1*b* of the drive shaft 1 so that the drive-shaft end 1*a* having a larger diameter than that at the latch groove 1*b* restricts axial movements of the drive member 5, and also having the groove 7*c* to fit onto a projection 5*a* of the drive member 5 so that the stopper 7 rotates together with the drive member 5, with the idler grip 8 fixed by the stopper 7 and inside of which is provided the bearing 8*a* which rotatably supports the drive-shaft end 1*a*, and the screws 9 used to fix the idler grip 8 to the stopper 7. The stopper 7 may be divided into two as shown in FIG. 4(*b*) provided that it comprises shaft support groove 7*a*, with which the latch groove 1*b* of the drive shaft 1 engages, and threaded holes 7*b* as shown in FIGS. 4(*a*) and 4(*b*). Also, a gap is provided between the drive member 5 and the stopper 7 to permit the drive member 5 to move in an axial direction in which braking is released, and a suitable gap is provided between the projection 5*a* of the drive member 5 and the groove 7*c* of the stopper 7 to afford sliding in the axial direction. In addition, the drive shaft 1 is provided contiguous to the load sheave 10, and bearing portions of the load sheave 10 are rotatably supported in the frames 17*a*, 17*b*. Also, an outer peripheral surface of the drive member 5 is non-circular and has the lever 24 mounted thereon, and is latched on the stopper 7. Also, a main body of the winching and drawing machine is covered by the gear cover 18 and the brake cover 19.

An action of the winching and drawing machine according to the embodiment will be described. When the lever 24 is repeatedly swung in a winching-up direction at a time of loaded action, the drive shaft 1 is rotated via the drive member 5, the brake plates 3, and the brake bearing member 2 in a winching-up direction to cause the load sheave 10 to winch up the chain.

During a winching-down action at a time of loading, when a winching-up/winching-down switching piece provided on the lever 24 is switched over to a winching-down direction and the lever is repeatedly swung, the drive member 5 is rotated in a direction releasing the drive member 5 from the brake 3, whereby a braking action of the drive shaft 1 is released and the load sheave 10 is slightly rotated together with the drive shaft 1 in the winching-down direction by an amount corresponding to that by which the drive member 5 is released. A series of such actions are repeated, whereby winching-down of the chain is achieved.

Also, at a time of non-loading, when the switching piece of the lever 24 is switched over to a neutral position and an action of the idler spring 6 causes the drive member 5 to be released from the brake plates 3, there comes an idling state, in which a chain length can be freely adjusted. In this idling state, when a load is applied on the chain, a screwing action generates a pressing force of the drive member 5 on the brake plates 3, and thus rotation of the load sheave 10 in the winching-down direction is prevented.

Also, in the idling state, the drive member 5 is rotated by rotating the idler grip 8, and a screwing action of the drive member 5 causes unitary rotation of the drive shaft 1 and the load sheave 10 via the brake plates 3 and the brake bearing member 2 to enable adjusting the chain length in the winching-up direction by a desired length without contacting the chain.

Also, by rotating the idler grip 8 in a direction, in which the drive member 5 is loosened from the drive shaft 1, a restrictive action of the stopper 7 restricts axial movements of the drive member 5, so that the drive member 5, the drive shaft 1, the load sheave 10, and the like are rotated integrally in the winching-down direction whereby it is possible to adjust the chain length without contacting the chain.

While the embodiment has been described with respect to that configuration in which the projection is provided on the drive member and the projection is fitted into the groove of the stopper to effect engagement of the drive member and the stopper, a configuration will suffice in which a projection is provided on the stopper and the projection of the stopper is fitted into a recess of the drive member, a configuration will suffice in which a projection is provided on the idler grip and the projection may be inserted through the stopper to engage with the drive member, and a configuration will suffice in which a projection is provided on the drive member and the projection may be inserted through the stopper to engage with the idler grip.

Figure 4:
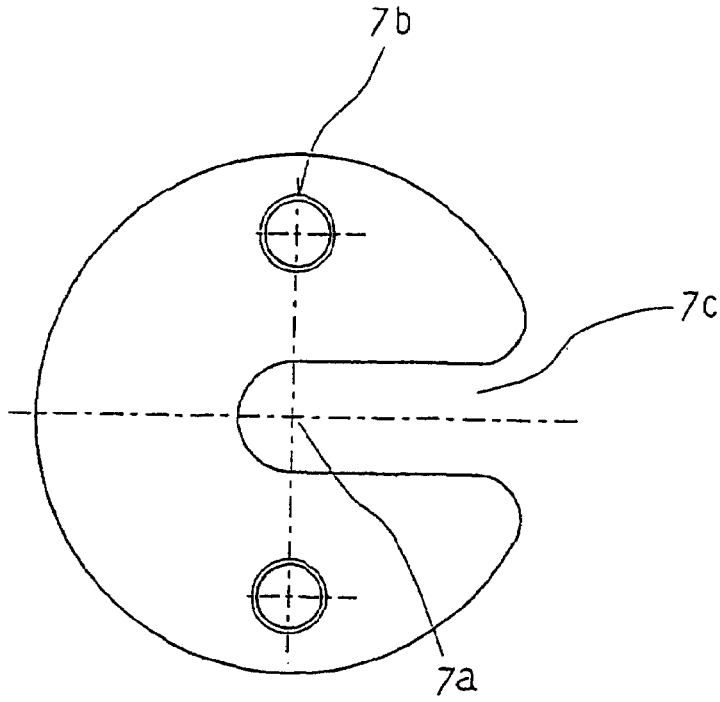
FIGS. 4(*a*) and 4(*b*) are plan views showing a stopper according to a first embodiment of the invention.
Figure 4:
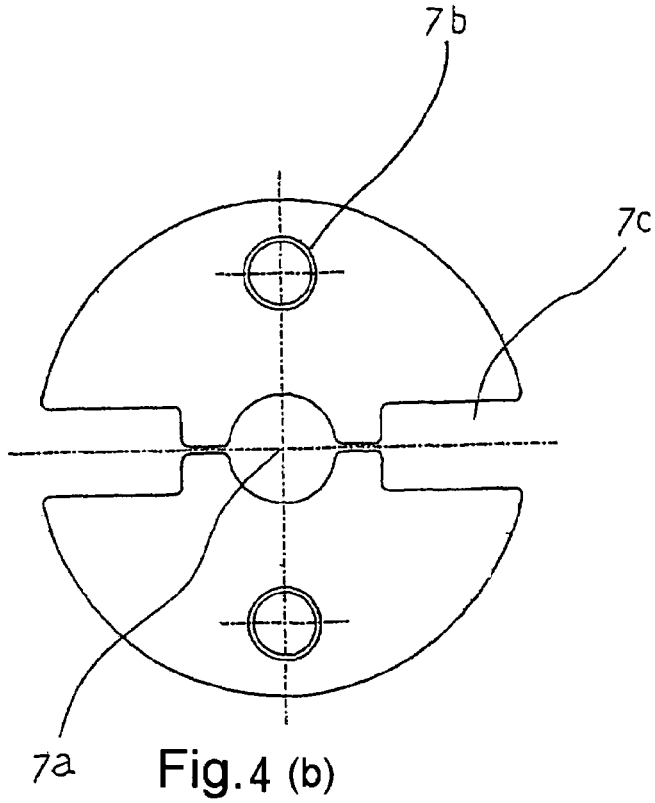

Also, the stopper may be shaped to comprise a shaft support groove to engage with the drive shaft, it may be in a form of a single plate as shown in FIG. 4(*a*), and it may be in a form of two plates as shown in FIG. 4(*b*).

In this manner, according to the embodiment, the stopper 7 is provided on an end face of the drive member 5 to engage with the drive shaft 1 to restrict axial movements of the drive member and to rotate together with the drive member 5 to perform an action of preventing the lever 24 from coming off, and the idler grip 8 is fixed on the stopper 7 to rotate the drive member 5, so that a conventional restrictive member for restriction of rotation of a drive member is unnecessary and miniaturization and lightening can be achieved since the idler grip is not fixed to the drive member. Also, since an end face of a handle mount on the winching and drawing machine is covered by the idler grip, the winching and drawing machine can be shaped more gracefully than conventional winching and drawing machines.

Further, as compared with an arrangement in which washers for mounting of a drive shaft and a handle are provided at an end of the drive shaft, a winching and drawing machine having multiple functions can be provided in the embodiment because it is possible to adjust the chain length without contacting the chain.

Second Embodiment

An idler spring mechanism according to a second embodiment will be described with reference to FIGS. 2, 3, and 5 to 7.

In these figures, reference numeral 1*c* denotes a latch step provided on an end of that portion 1*e* of the drive shaft 1 on which the brake plates 3 are fitted, 1*d* a small-diameter portion of the drive shaft 1, 6*a* a small-diameter portion of the idler spring 6, 6*b* a large-diameter portion of the idler spring, and 23 female threads provided on the drive member and screwed on the multiple threads 22.

Figure 5:
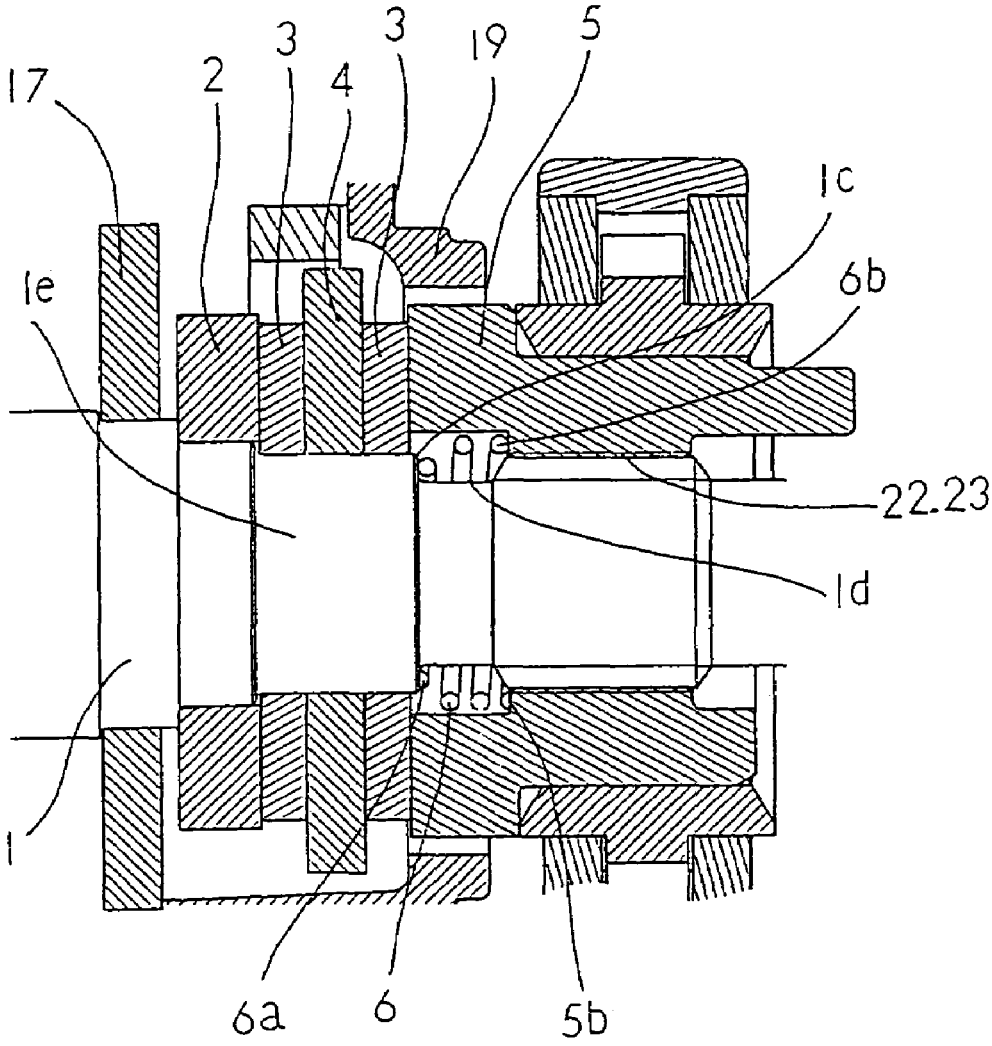
FIG. 5 is an enlarged, front view showing a mechanism related to an idler spring according to a second embodiment of the invention.
Figure 6:
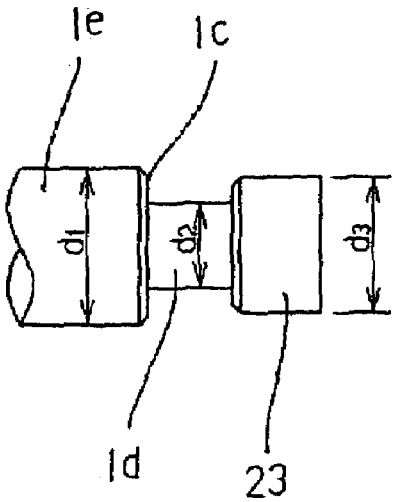
FIG. 6(*a*) is a front view showing a portion on which the idler spring is mounted, and FIG. 6(*b*) is an enlarged front view showing the idler spring, in FIG. 5.
Figure 6:
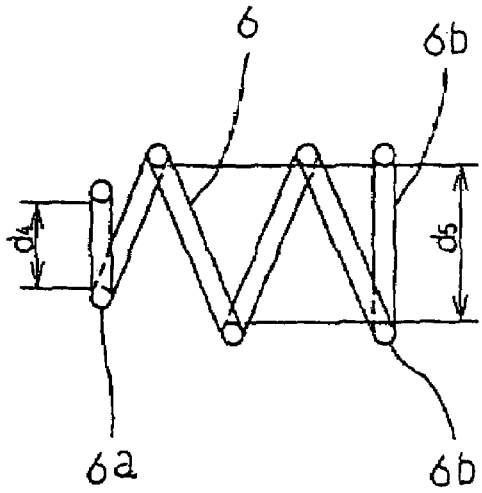

FIG. 5 is an enlarged view showing an entire idler spring mechanism, FIG. 6(*a*) is an enlarged view of FIG. 5, showing that portion of the drive shaft 1 on which the idler spring is mounted, and FIG. 6(*b*) is an enlarged view showing the idler spring. As shown in these figures, the idler spring 6 comprises the small-diameter portion 6*a* being mounted on the small-diameter portion latch step 1*c* of the drive shaft 1, and the large-diameter portion 6*b* being mounted on a latch step 5*b* of the drive member 5, and diameter d1 of that portion of the drive shaft 1 on which the brake plates are fitted and mounted, diameter d2 of the small-diameter portion 1*d* of the drive shaft 1, outside diameter d3 of the multiple threads, inside diameter d4 of the small-diameter portion 6*a* of the idler spring 6, inside diameter d5 of the large-diameter portion 6*b*, and wire diameter d6 of the idler spring 6 are sized so that the following relationships exist: $d1 \approx d3$, $d2 < d4 \leqq d1 - 2d6$, $d3 < d5$. When the idler spring 6 is to be mounted on the drive shaft 1, the small-diameter portion 6*a* of the idler spring 6 is rotated along threaded grooves of the multiple threads 22 and thus advances, and the small-diameter portion 6*a* of the idler spring 6 is fitted onto the small-diameter portion 1*d* of the drive shaft 1 and is mounted on the small-diameter portion latch step 1*c*. In addition, the large-diameter portion 6*b* is mounted on the latch step 5*b* of the drive member 5.

In this manner, according to this embodiment, by making a mount portion of the idler spring 6 toward the brake plates small in diameter as compared with a mount portion toward the drive member, parts such as the brake plates 3 and the brake bearing member 2 mounted thereon can be also made small in diameter, so that it is possible to make the winching and drawing machine in its entirety small in size.

Figure 7:
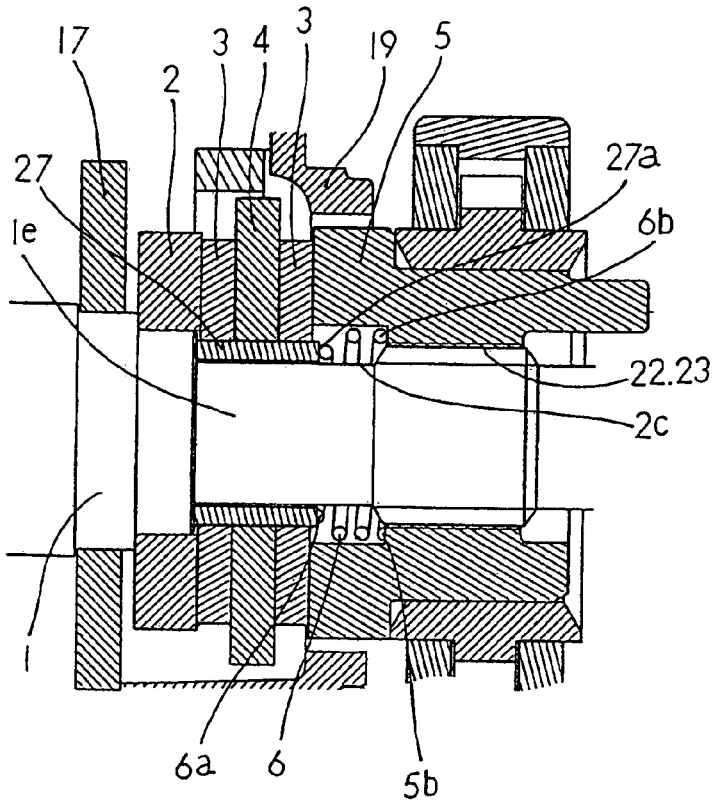
FIG. 7(*a*) is an enlarged front view showing a mechanism related to an idler spring according to a further embodiment, and FIG. 7(*b*) is a cross sectional view showing a slide bearing in FIG. 7(*a*).
Figure 7:
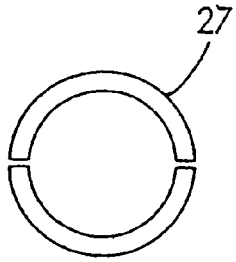

FIGS. 7(*a*) and 7(*b*) show still another embodiment. While according to the embodiment shown in FIG. 5, the brake member comprising the pawl wheel 4 and the brake plates 3 is mounted on the drive shaft 1 and the small-diameter portion 6*a* of the idler spring 6 is mounted on the latch step 1*c* of the drive shaft 1, according to the embodiment shown in FIGS. 7(*a*) and 7(*b*) a slide bearing member 27 divided into two halves in cross section as shown in FIG. 7(*b*) is mounted between the brake member comprising a pawl wheel 4 and brake plates 3 and the drive shaft 1, and the small-diameter portion 6*a* of the idler spring 6 is mounted at an end face 27*a* of the slide bearing member 27. With such construction, it is possible to produce the same effect as that in the embodiment shown in FIG. 5.

Further, guide rollers 14*a*, 14*b* are provided at one end of the drive shaft 1 to guide chain 30 wound around load sheave 10, and one of the guide rollers 14*a*, 14*b* is provided to be coaxial with the drive shaft 1 to contact an outside of the chain 30 wound around the load sheave 10, whereby it is possible to provide a winching and drawing machine in which in addition to achieving effects of the above embodiment a number of parts can be decreased, a body of the winching and drawing machine can be made small in size and lightweight, and assembling steps can be reduced, which machine is inexpensive as compared with conventional winching and drawing machines in which guide rollers 14*a*, 14*b* are borne as separate parts by frames 17*a*, 17*b*.

An operation of this embodiment will be described.

When the lever 24 fitted onto the drive member 5 is swung back and forth, the drive member 5 is moved against the idler spring 6 in a direction toward the brake plates 3 under a feeding action of the multiple threads 22 to push the brake bearing member 2 against the bearing step of the drive shaft 1. Since axial movement of the brake bearing member 2 is prevented by the bearing step of the drive shaft 1, the drive member 5 is rotated integrally with the brake plates 3, pawl wheel 4, brake bearing member 2, and the drive shaft 1 under a clamping action of the multiple threads 22.

On the other hand, when the chain 30 is operated at a time of non-loading, the drive member 5 is biased by the idler spring 6 in a loosening direction and the brake plates 3 and the pawl wheel 4 are released, so that the drive shaft 1, the brake bearing member 2, and the drive member 5 are rotated integrally via the load sheave 10 and the load gear 12 to be put in an idling state, in which it is possible to freely operate the chain 30. In addition, stopper 7 is mounted on an end of the drive shaft 1 to prevent the drive member 5 from loosening excessively at a time of idling.

According to the invention, by making the side of the idler spring where the brake plates are mounted smaller in diameter than the side where the drive member is mounted, and mounting the small-diameter portion on a latch portion provided on the side where the brake plates are mounted, the drive shaft can be made smaller in diameter than that of conventional winching and drawing machines, and respective parts mounted on the drive shaft can be also made small in diameter, so that it is possible to provide a winching and drawing machine, which can be made small in size, lightweight and inexpensive.

Further, the guide rollers for guiding the chain wound around the load sheave are formed to be coaxial and integral with the drive shaft whereby it is possible to decrease a number of parts and thus make a body of the winching and drawing machine small in size, lightweight and inexpensive.

Third Embodiment

Figure 8:
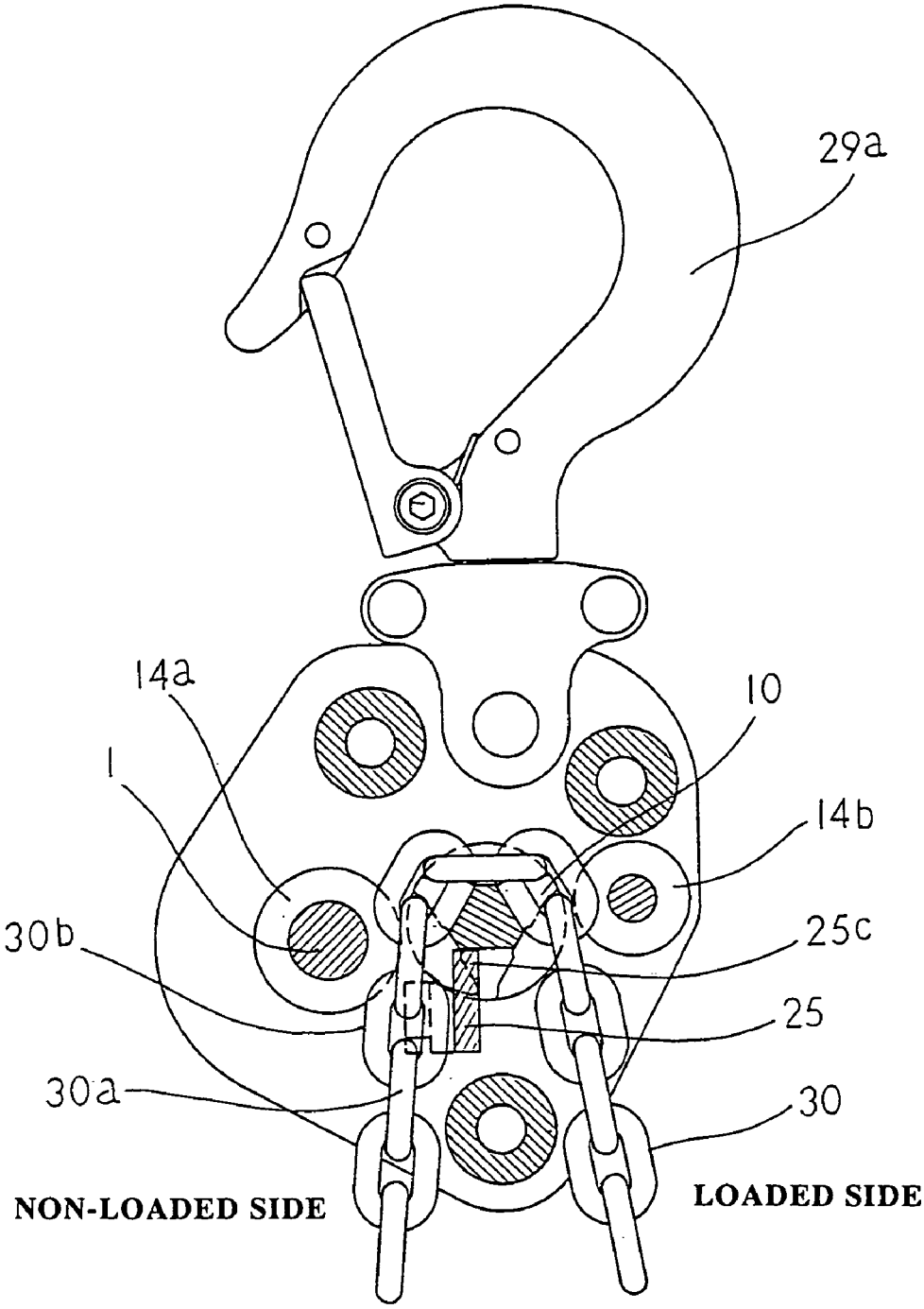
FIG. 8 is a front, cross sectional view showing a chain guide according to third and fourth embodiments of the invention.

A related construction of guide rollers and a drive shaft according to a third embodiment will be described with reference to FIGS. 2, 3, and 8.

In these figures, reference numerals 17*a*, 17*b* denote the pair of frames to bear thereon the load sheave and drive shaft. 1 is the drive shaft on which the brake bearing member 2 is fitted at a side, around which pawl wheel 4 is fitted contiguous to the brake bearing member 2 and interposed between the pair of brake plates 3, and with multiple threads 22 having the drive member 5 screwed thereon on frame 17*b* side. Guide rollers 14*a*, 14*b* supported between the support frames 17*a*, 17*b* and the pinion gear 13 are provided on the other side of the drive shaft. The pinion gear 13 is provided on an end of the drive shaft 1 and borne by the outer support frame 17*b*. Reference numeral 14*a* denotes the non-load side guide roller formed integral with the pinion gear 13 with its axis borne between the support frames 17*a*, 17*b* to guide a non-loaded chain, 14*b* the load side guide roller borne between the support frames 17*a*, 17*b* to guide the loaded chain, 2 the brake bearing member fitted onto the drive shaft 1 to be axially movable and non-rotatable relative to the drive shaft, 4 the pawl wheel borne by the drive shaft 1, 3 the brake plates borne by the drive shaft 1 to interpose the pawl wheel 4 from left and right, 6 the idler spring interposed between a step of the drive shaft and the drive member 5, 5 the drive member screwed on multiple threads 22 provided on the drive shaft 1, 22 multiple threads, 7 the stopper screwed on an end of the drive shaft 1, 12 the load gear to mesh with the pinion gear 13, 10 the load sheave being coaxial with the load gear 12 and rotatably supported between the frames 17*a*, 17*b*, and 30 the chain wound around the load sheave.

With the frames 17*a*, 17*b* positioned at a center of the drive shaft 1, the brake bearing member 2 is fitted onto one side of the drive shaft 1 to be non-rotatable relative thereto, and abuts the bearing step of the drive shaft 1. The pawl wheel 4 interposed between the pair of brake plates 3 is borne by the drive shaft 1 in front of the brake bearing member 2, and the reverse-rotation preventive pawl 21 pivotally mounted on the frame 17*a* and biased toward a latch tooth provided on an outer periphery of the pawl wheel 4 engages with the latch tooth to rotate the pawl wheel 4 in a winching-up direction. The drive member 5 is screwed on the multiple threads 22 provided on the drive shaft 1 and rotated by the lever 24 fitted onto an outer periphery of the drive member.

Also, the non-load side guide roller 14*a* formed integral with the drive shaft 1 is fixed between the frames 17*a*, 17*b* on the other side of the drive shaft 1, and the pinion gear 13 is provided outside the support frame 17*b*.

The pinion gear 13 is provided outside the frame 17*b* to mesh with the load gear 12 externally fitted onto the sheave shaft 11 of the load sheave 10. In addition, the load side guide roller 14*b* is borne by the frames 17*a*, 17*b* on an opposite side of the load sheave 10 from the non-load side guide roller 14*a* to guide the loaded-side chain 30.

An operation of this embodiment will be described.

When the lever 24 fitted onto the drive member 5 is turned back and forth, the drive member 5 is moved against the idler spring 6 in a direction toward the brake plates 3 under a feeding action of the multiple threads 22 to push the brake bearing member 2 against the bearing step of the drive shaft 1. Since axial movement of the brake bearing member 2 is prevented by the bearing step of the drive shaft 1, the drive member 5 is rotated integrally with the brake plates 3, the pawl wheel 4, the brake bearing member 2, and the drive shaft 1 under a clamping action of the multiple threads 22.

The non-load side guide roller 14 and the pinion gear 13 rotate together with the drive shaft 1 to rotate the load sheave 10 via the load gear 12, whereby winching-up or drawing is effected by the chain 30 wound around the load sheave 10. As shown in FIG. 8, the non-load side and load side guide rollers 14*a*, 14*b* contact an exterior of the chain 30 wound around the load sheave 10 to guide the chain 30 to the load sheave 10.

As described above in detail, the winching and drawing machine according to the invention comprises the non-load side and load side guide rollers 14*a*, 14*b* to guide the chain 30 wound around the load sheave 10, with the non-load side guide roller 14*a* being provided coaxial with the drive shaft 1, so that it is possible to provide a winching and drawing machine in which a number of parts and manufacture steps can be decreased, and which is small in size, lightweight and inexpensive.

In addition, while an example has been described in which the non-load side guide roller 14*a* is formed integral with the drive shaft 1, the non-load side guide roller may be rotatably borne by the drive shaft, and such construction may also be applied to a load side guide roller. Also, in a case where the non-load side guide roller 14*a* and the drive shaft 1 are formed integral with each other, the non-load side guide roller 14*a* rotates integrally with the pinion 13. Since no load is applied on the non-load side guide roller 14*a* and no frictional force is generated, the non-load side guide roller 14*a* is not affected by frictional forces, or the like even when rotating integrally with the pinion 13, so that the non-load side guide roller 14*a* is preferably formed to be integral with the drive shaft 1.

According to the invention, since the non-load side guide roller is provided coaxial with the drive shaft and a part of the drive shaft is made a guide roller, it is possible to provide a winching and drawing machine in which a number of parts can be decreased, a body of the winching and drawing machine can be made small in size and lightweight, and inexpensive compared with conventional winching and drawing machines in which guide rollers are borne as separate parts by frames.

Fourth Embodiment

A chain guide according to a fourth embodiment will be described with reference to FIGS. 2 and 8 to 11(*c*).

In these figures, a winching and drawing machine comprises an upper hook 29*a* in an upper portion thereof, and a lower hook in a lower portion thereof, and a body of the machine comprises load sheave 10, link chain 30 wound around the load sheave 10, non-load side guide roller 14*a* to guide engagement of the link chain 30 with the load sheave 10, with the non-load side guide roller 14*a* being contacted from outside a non-load side link chain forwarding region of the link chain, and an inner guide 25 forming together with the non-load side guide roller 14*a* a forwarding port of the non-load side link chain, with the inner guide 25 being provided close to a lower portion of the load sheave 10. The non-load side guide roller 14*a* is rotatably provided to extend from drive member 5 via brake portions 2 to 4 to a reduction gear section and to be coaxial and integral with drive shaft 1, which is provided with pinion gear 13 to transmit driving force of the drive member 5 to load gear 12. Reference numeral 30*a* denotes transverse links of the link chain 30, 30*b* vertical links, and the non-load side guide roller 14*a* is in a form of a roller and comprises a groove 14*c*, into which the vertical links 30*b* are fitted. A guide surface of the inner guide

25 comprises a positioning guide slope 25*a*, which is substantially in a V-shape with which the transverse links 30*a* come into sliding contact and become aligned in parallel to the load-sheave surface of the load sheave 10, and a positioning valley 25*b* for positioning the vertical links 30*b* which is provided at its end closer to the load sheave with a tip projection 25*c*, by which the link chain being forwarded to a non-loaded side is prevented from being wound on the load sheave 10. Reference numeral 25*d* denotes a mount provided at an end of the inner guide 25 to mount the inner guide 25 to a body frame of the winching and drawing machine. Reference numeral 25*e* denotes a slope portion contiguous with the load sheave 10, sloping in a direction from a lower portion of the load sheave 10 toward the non-load side guide roller 14*a*, with the slope portion enabling the guide slope 25*a* to be provided close to the non-load side guide roller 14*a* and thus functioning to improve quality of guiding the transverse links 30*a*. Reference numeral 14*b* denotes an outer guide on a loaded side.

Figure 9:
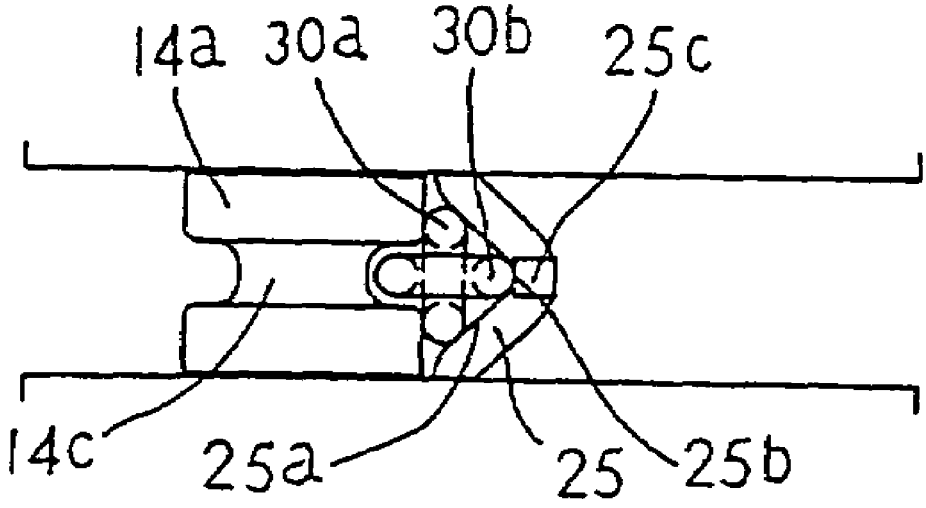
FIG. 9 is a plan view showing the chain guide according to the fourth embodiment of the invention.
Figure 10:
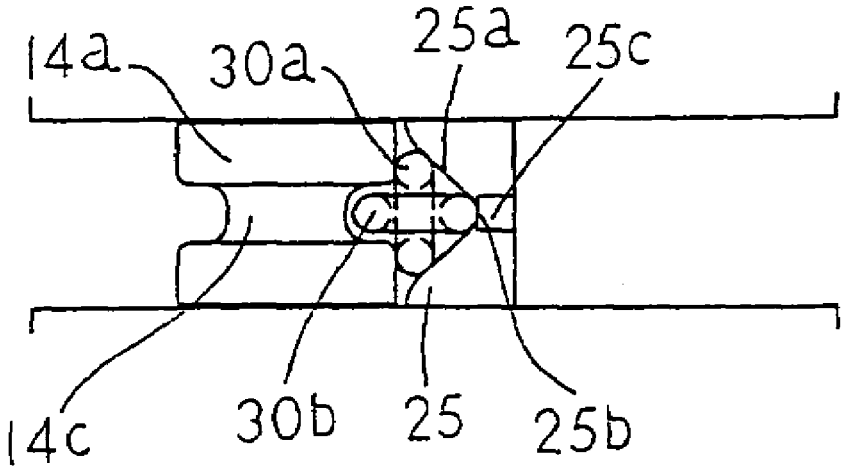
FIG. 10 is a plan view showing a chain guide according to a further embodiment.
Figure 11A:
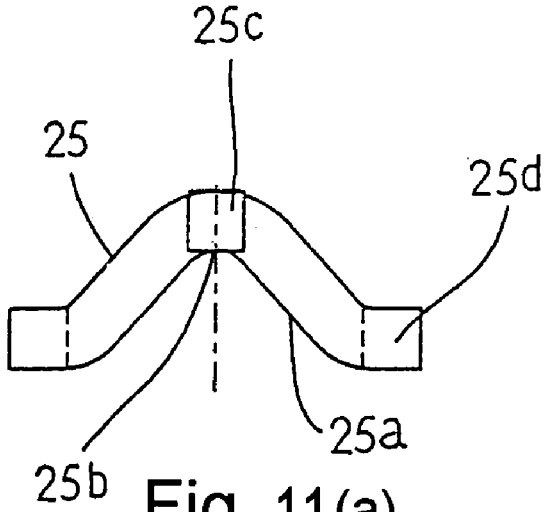
FIG. 11(*a*) is a plan view showing an inner guide in FIG. 9, FIG. 11(*b*) is a front view, and FIG. 11(*c*) is a right side view.
Figure 11B:
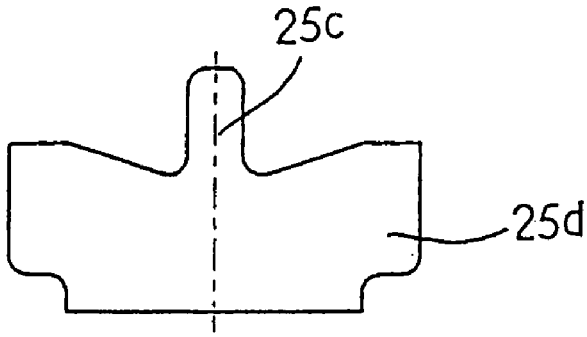
Figure 11C:
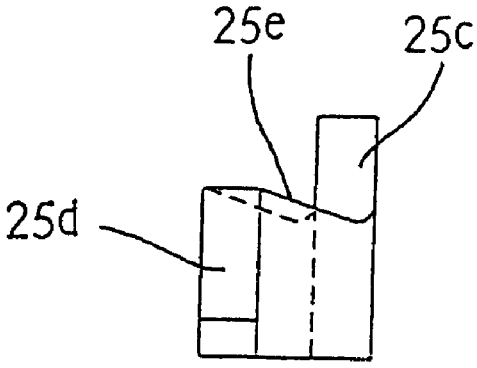

In addition, the inner guide 25 can be manufactured not only by working a sheet-shaped body by performance of press working as shown in FIGS. 9 and 11(*a*)-11(*c*), but also by integral molding of a non-sheet body by performance of cold forging or precision casting as shown in FIG. 10.

Next, an action of the winching and drawing machine according to this embodiment will be described.

A chain guide according to the embodiment comprises the non-load side guide roller 14*a* provided with the groove 14*c* for guiding of the vertical links, and the inner guide 25 which is substantially V-shaped, having the slope 25*a* for guiding of the transverse links, and the valley 25*b* for guiding of the vertical links. The inner guide 25 is provided with one end facing the load sheave and the tip projection 25*c* at that end, by which the link chain being forwarded to a non-loaded side from the load sheave 10 is prevented from being wound on the load sheave 10.

Therefore, when a winching-down action of the link chain 30 is taken, the transverse links 30*a* of a non-loaded link chain forwarded onto the chain guide come into sliding contact with the slope 25*a* of the inner guide 25 to be automatically aligned so that the transverse links 30*a* are parallel to a load-sheave surface of the load sheave 10, and a vertical link 30*b* forwarded to the chain guide subsequent to a transverse link 30*a* is guided by the groove 14*c* of the non-load side guide roller 14*a* and the valley 25*b* of the inner guide 25 to be forwarded to the load sheave 10. Therefore, the link chain 30 is forwarded to the load sheave 10 without interference such as being caught by the non-load side guide roller 14*a* between the chain guide and the load sheave 10, so that the winching-down action is smoothly taken to enable preventing damage from being caused on the chain at a time of the winching-down action.

Also, at a time of a winching-up action, among the links in the chain forwarded to the non-loaded side from the load sheave 10, the vertical links 30*b* fitted into the groove of the load sheave 10 are pushed out by the tip projection 25*c* provided on the inner guide 25 in a direction away from the groove of the load sheave 10, so that at the time of the winching-up action the link chain 30 is prevented from being enfolded on the load sheave 10.

According to the invention, when a winching-down action of the link chain is taken, transverse links of the chain forwarded onto the chain guide are restricted in inclination by the slope of the inner guide, a position of the link chain relative to the load sheave is automatically regulated so that the link chain is positioned centrally in the load sheave, a vertical link forwarded subsequent to a transverse link is also restricted in inclination, and vertical links are fitted between a groove of the outer guide and the valley of the inner guide to be forwarded, so that the link chain is not caught by the outer guide between the chain guide and the load sheave and the winching-down operation can be smoothly performed to enable preventing damage from being caused on the link chain.

Fifth Embodiment

A connecting construction of a load gear and a load sheave shaft according to a fifth embodiment will be described with reference to FIGS. 2, 3 and 12(*a*) to 14.

Figure 12:
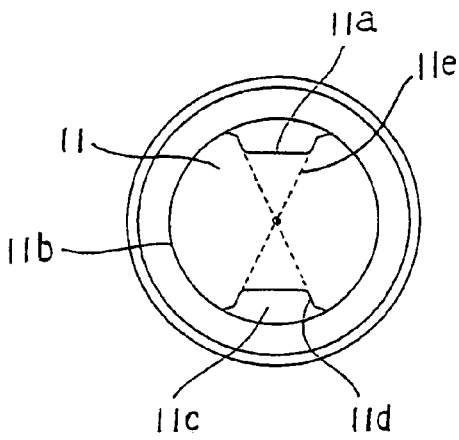
FIG. 12(*a*) is an enlarged cross sectional view showing a load sheave according to a fifth embodiment of the invention, and FIG. 12(*b*) is a front view.
Figure 12:
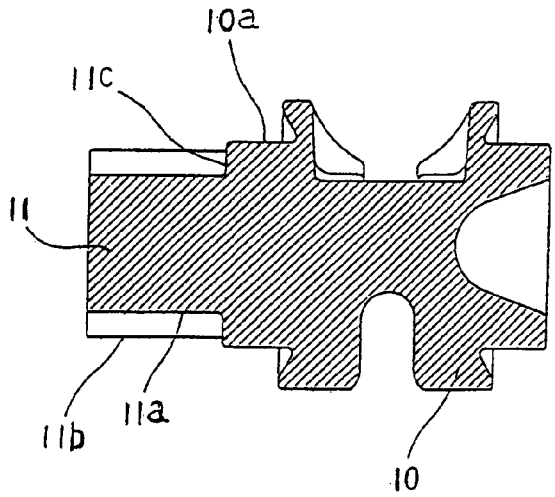
Figure 13:
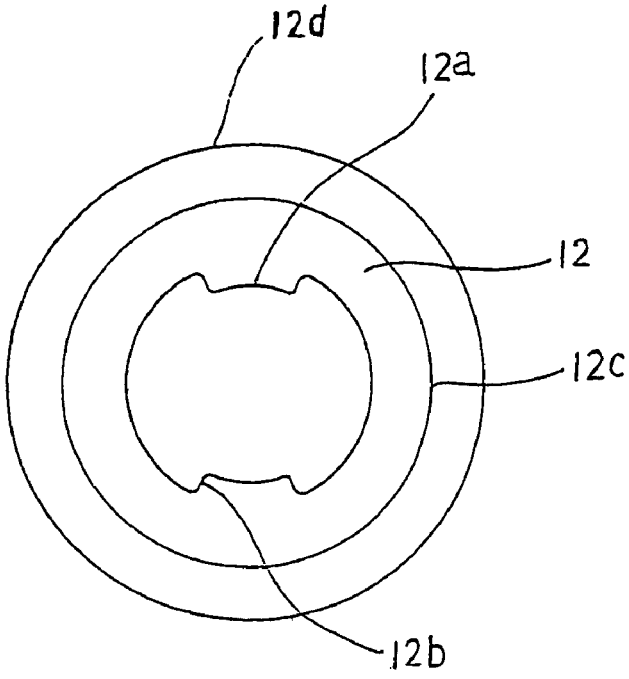
FIG. 13(*a*) is an enlarged cross sectional view showing a load gear according to the fifth embodiment, and FIG. 13(*b*) is a front view.
Figure 13:
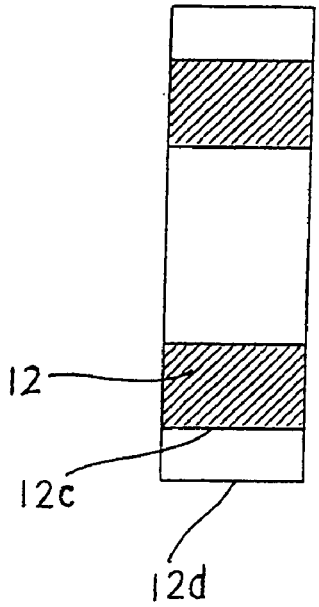
Figure 14:
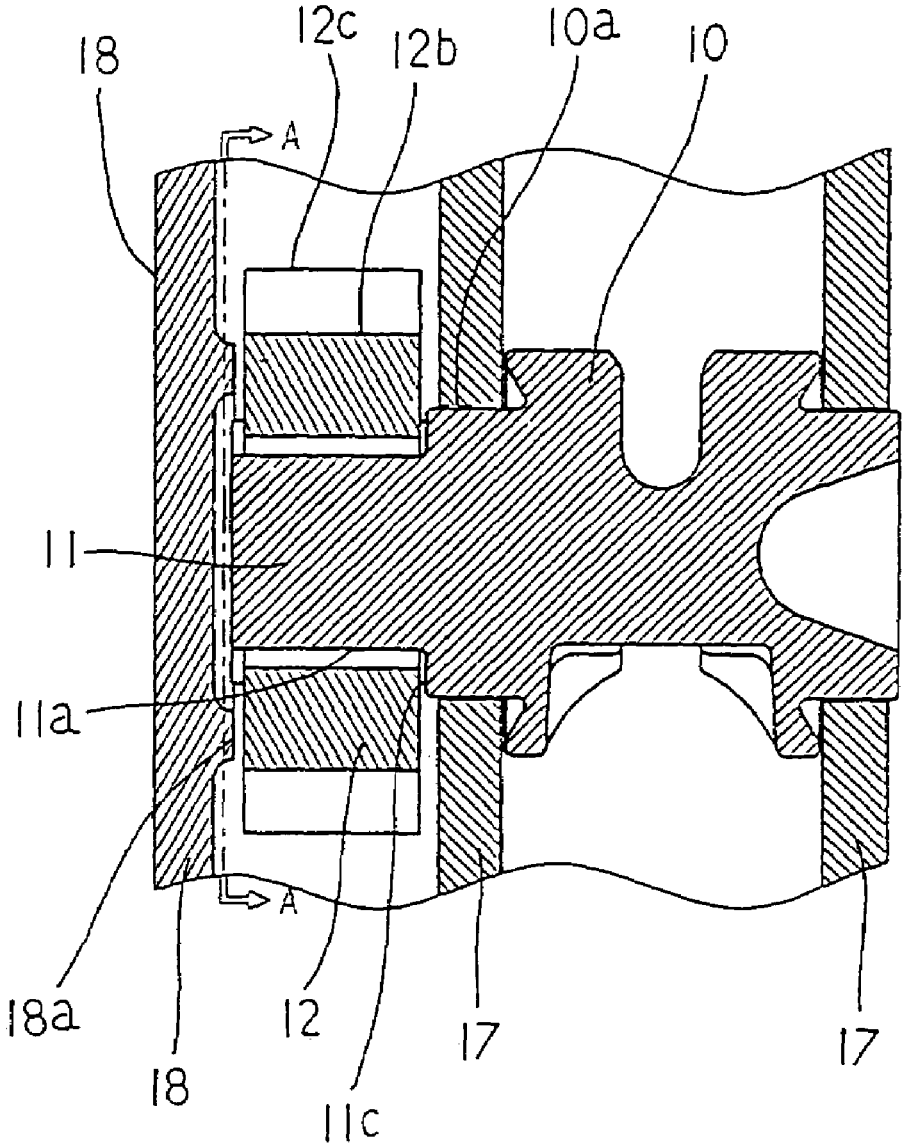
FIG. 14 is a side view showing a state, in which the load sheave and the load gear are assembled together.
Figure 15:
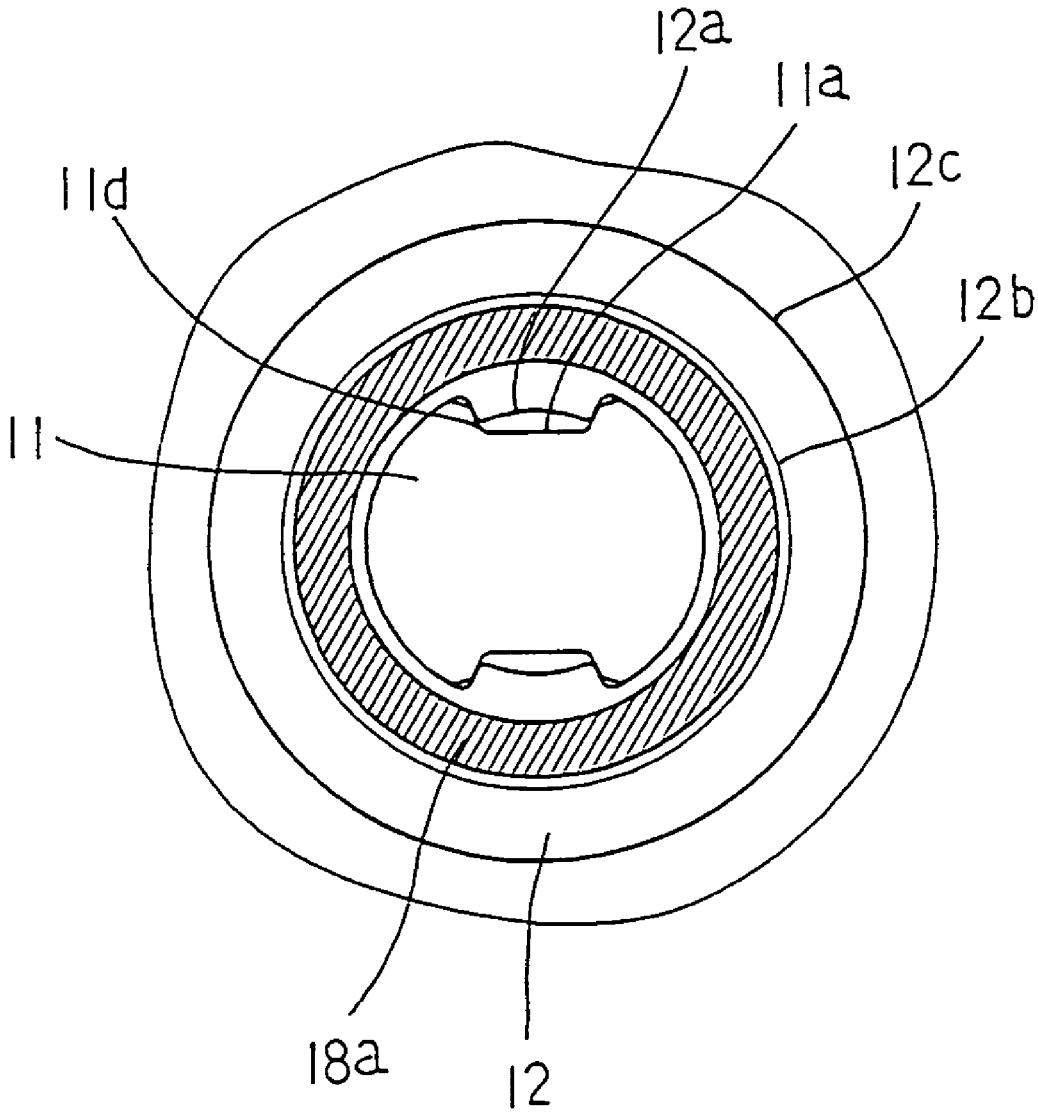
FIG. 15 is a cross sectional view taken along line A-A in FIG. 14.

In FIGS. 12(*a*) and 12(*b*), reference numeral 10 denotes a load sheave, 10*a* a bearing, at which the load sheave 10 is supported by a frame 13, and 11*a* sheave shaft provided at a tip end of the load sheave 10. According to this embodiment, a pair of upper and lower grooves 11*a* are provided axially of the sheave shaft 11 to be contiguous to the bearing 10*a* of the load sheave 10. Sides of the grooves 11*a* in a circumferential direction of the sheave shaft 11 are provided with slopes 11*d*, which are defined by lines 11*e* passing through an axis of the sheave shaft 11 and thus inclined in radial directions, and flat restriction surfaces 11*c* are provided on a side of the grooves 11*a* toward the bearing 10*a* to restrict movement of the load gear 12 toward the load sheave 10. FIGS. 13(*a*) and 13(*b*) show the load gear 12, and reference numeral 12*a* denotes projections fitted into the grooves 11*e* of the sheave shaft 11 and provided with slopes 12*b* that contact the slopes 11*d* of the groove 11*a* of the sheave shaft 11. Reference numeral 12*c* denotes a bottom of the gear, and 12*d* a tip of the gear. FIGS. 14 and 15 show a state in which the load gear 12 is fittingly mounted on the load sheave 10, and the projections 12*a* of the load gear 12 are fitted into the grooves 11*a* of the sheave shaft 11 with respective slopes 11*d*, 12*b* in contact.

Also, the load gear 12 is restricted in movement toward the load sheave 10 by the restriction surfaces 11*c* provided at an end of the bearing 10*a* of the load sheave 10. Also, a convex-shaped ring 18*a* is provided on an inner side of a gear casing 14 to come into sliding contact with the load gear 12 to guide rotation of the load gear 12 and to restrict movement of the load gear 12 toward the gear casing 14, and the load gear 12 is restricted in left and right movements between the restriction surfaces 11*c* of the load sheave 10 and the convex-shaped ring 18*a* on the gear casing 14.

In addition, the convex-shaped ring 18*a* is set to be smaller in outside diameter than that of the bottom 12*c* of the load gear 12 and larger in inside diameter than outside diameter 11*b* of the sheave shaft 11, in order to smoothly bring the load gear 12 into sliding contact.

While strength of the sheave shaft splined all over its circumference is conventionally ensured by making a sheave shaft thick, the present embodiment is advantageous in strength since only grooves are formed on the sheave shaft and the grooves are not formed on an entire periphery of the sheave shaft. Further, since the grooves are provided with slopes which are defined by lines passing through a center of the sheave shaft, a direction of torque transmission is made circumferential and a surface of the sheave shaft which engages with the load gear is perpendicular to the slopes, loss in torque transmission can be decreased and a excessive load on the sheave shaft for torque transmission can be lessened, so that it is possible to reduce a number of grooves, or make the grooves small in configuration, which extremely facilitates working of the grooves.

Also, as compared with an arrangement in which the sheave shaft is splined, no relief space for working is needed on the sheave shaft, so that the winching and drawing machine can be made small in size, lightweight, and low in cost.

Also, since the grooves for fitting of the load gear 12 are very simple in constitution as compared with splines, they can be worked at the same time as casting of the load sheave, so that working of the sheave shaft can be made markedly low in cost as compared with conventional devices and working steps are few, which can enhance productivity.

Furthermore, the convex-shaped ring is provided on the inner side of the gear casing to make unnecessary any member that restricts movement of the load gear toward the gear casing, whereby reduction in cost can be achieved.

In addition, while this embodiment has been described with respect to an example in which grooves are provided in pairs, a single groove will suffice, or three to four grooves may be provided.

Also, while an explanation has been given to an arrangement in which the convex-shaped ring for restriction of movements of the load gear toward the gear casing is provided on the inner side of the gear casing, the convex-shaped ring may be provided on an end of the load gear facing toward the gear casing.

As described above, since according to the invention, grooves in place of conventional splines or the like are provided on the sheave shaft and the load gear is fittingly mounted on the grooves, no relief space for the working is needed on the sheave shaft, so that the machine in its entirety can be made small in size, lightweight, and low in cost. Since the grooves are provided with slopes which are inclined toward the axis of the sheave shaft, the direction of torque transmission is made circumferential, torque transmission can be smoothly effected, and a force load on the sheave shaft can be lessened, so that it is possible to reduce the number of grooves, or make the grooves small in configuration, which extremely facilitates working of the grooves. Also, since the grooves can be worked at the same time as casting of the load sheave, working of the sheave shaft can be made markedly low in cost. Also, since there is no need of providing any member that restricts movement of the load gear toward the gear casing, reduction in cost can be achieved.

Sixth Embodiment

A winching and drawing machine according to a sixth embodiment of the invention will be described with reference to FIGS. 2 and 16 to 18. In these figures, reference numeral 18 denotes a gear cover that covers gears on a side of a load gear 12 of a body of the winching and drawing machine, with the gear cover being provided with threaded holes into which bolts 16 are screwed, a recess 18*b* into which small-diameter portions 15*b* of spacers 15*a*, 15*b* are fitted, and an inner end surface 18*c* that projects inward and fixes a frame. Reference numeral 19 denotes a brake cover that covers a brake member of a body of the winching and drawing machine, with the brake cover being provided with holes 19*a* into which bolts described later are inserted, a recess 19*b* into which small-diameter spacer portions 15*d* are fitted, and an inner end surface 19*c* that fixes the frame. Also, the brake cover 19 is provided with an expansion portion 19*d* that expands only by an amount corresponding to an open space of the brake member, and seats 19*e* that accommodate therein heads of the bolts. Support frames 17*a*, 17*b* of the body of the winching and drawing machine are provided with holes into which the small-diameter portions 15*d* of the hollow spacers 15*a*, 15*b* are fitted, steps 15*f* provided on the hollow spacers 15*a*, 15*b* prescribe a spacing between the frames, and bolts 16 inserted through the hollow spacers 15*a*, 15*b* clamp the support frames to the body. Reference numerals 15*a*, 15*b* denote the hollow spacers that prescribe mount positions of the frames 17*a*, 17*b* and a spacing between the frames 17*a*, 17*b*, with the hollow spacers having small-diameter portions 15*d* at both ends thereof, wherein the small-diameter portion 15*d* of the hollow spacer 15*a* on a side toward the load gear is fitted into the hole of the frame 17*a* and the inner recess 18*b* of the gear cover 18, and the small-diameter portion 15*d* on the side toward the brake member is fitted into and fixed to the hole of the frame 17*b* and the inner recess 19*b* of the brake cover 19. The small-diameter portion 15*d* of the hollow spacer 15*b* on the side toward the load gear is fitted into the inner recess 18*b* of the gear cover 18, and the small-diameter portion 15*d* on the side toward the brake member is fitted into and fixed to the hole of the frame 17*b*. Also, a small-diameter portion 15*i* engages with and supports a reverse-rotation preventive pawl 21 to which a pawl wheel 4 is fitted. Since three hollow spacers maintain a spacing between the support frames 17*a* and 17*b* and the small-diameter portions 19*b* of the hollow spacer are fitted into and fix the holes provided on the support frames and the inner recesses 18*b* of the gear cover 18, the frames 17*a*, 17*b* and other parts can be simply assembled together without clearances therebetween, and offset of the spacers 15*a*, 15*b* perpendicular to axes of the spacers 15*a*, 15*b* can be restricted. Also, the frames 17*a*, 17*b* are fixed between the steps 15*f* provided on the hollow spacers 15*a*, 15*b* and inner end surfaces 18*c*, 19*c* of the gear cover 18 and the brake cover 19. In addition, the hollow spacer 15*b* comprises a step 15*g* that restricts axial, movement of the reverse-rotation preventive pawl 21. Reference numeral 16 denotes bolts having heads provided with hexagonal holes, with the bolts being inserted into the hollow spacers 15*a*, 15*b* from the holes 19*a* provided on the brake cover 19, and ends of the bolts being screwed into and fixed to threaded holes of the gear cover 18. Accordingly, when the bolts 16 are clamped, the frames 17*a*, 17*b* are positioned and fixed between the inner end surface 18*c* of the gear cover 18 and the steps 15*f* of the hollow spacers 15*a*, 15*b*.

As described above, the invention comprises the steps 15*f* interposed between the gear cover 18 and the brake cover 19 and provided on adjoining surfaces of the frames 17*a*, 17*b*, the spacers 15*a*, 15*b* having the small-diameter portions 15*d* that are fitted into the recesses 18*b*, 19*b* of the gear cover 18 and the brake cover 19, and the bolts 16 inserted through the through-holes provided in the spacers 15*a*, 15*b* to fix the brake cover 19 and the gear cover 18, and has a feature in that the frames 17*a*, 17*b* are fixed between the steps 15*f* of the spacers 15*a*, 15*b* and the inner end surfaces of the gear cover 18 and the brake cover 19. The invention can provide a compact and precise winching and drawing machine, in which the steps of the hollow spacers 15*a*, 15*b* determine a spacing between the frames 17*a*, 17*b*, on which the load sheave 10 is supported, by clamping the bolts 16, the frames 17*a*, 17*b* are interposed and fixed in a desired position between the steps 15*f* provided on the spacers 15*a*, 15*b* and the inner end surfaces of the gear cover 18 and the brake cover 19, and the small-diameter portions 15*d* of the spacers 15*a*, 15*b* are fitted into the holes of the frames 17*a*, 17*b*, the recess 18*b* of the gear cover 18 and the recess 19*b* of the brake cover 19, so that there are no clearances between the frames and other parts, thereby preventing dislocation such as offset at a time of assembling.

Also, since the bolts 16 are inserted into the hollow spacers 15*a*, 15*b* from the holes 19*a* of the brake cover 19 and ends of the bolts are screwed into and fixed to the threaded holes of the gear cover 18, the gear cover 18 can be placed on a lower side at the time of assembling, gears and other parts such as the brake member, and the like can be mounted and then covered with the brake cover 19, and the bolts 16 can be inserted and fixed from above the brake cover 19, so that it is not necessary to reverse the body and it is possible to provide a winching and drawing machine which is easy to assemble and disassemble.

Further, since the heads of the bolts 16 are received in seats 19*e* of the brake cover 19 and the ends of the bolts are screwed into the threaded holes of the gear cover 18, nuts are not needed and the bolts, are not exposed outside, so that it is possible to provide a winching and drawing machine to solve a problem that disassembly is made difficult due to generation of rusting of bolts or damage to the bolts such as when the machine is dropped.

Also, since nuts are not used and bolts having heads provided with hexagonal holes are used, it is possible to provide a compact winching and drawing machine to restrict space in a gear casing and a brake cover needed for use of spanners.

In addition, while this embodiment has been described illustrating the hollow spacers 15*a*, 15*b*, it is not limited thereto, and non-hollow spacers will suffice provided that they can position the support frames and interpose the frames between the inner end surfaces of the gear casing and the brake cover. Likewise, while the bolts have a configuration where they are inserted through the spacers, another configuration capable of interposing the spacers without bolts inserted through the spacers will suffice.

A further embodiment will be described below with reference to FIGS. 16 to 19.

Figure 19:
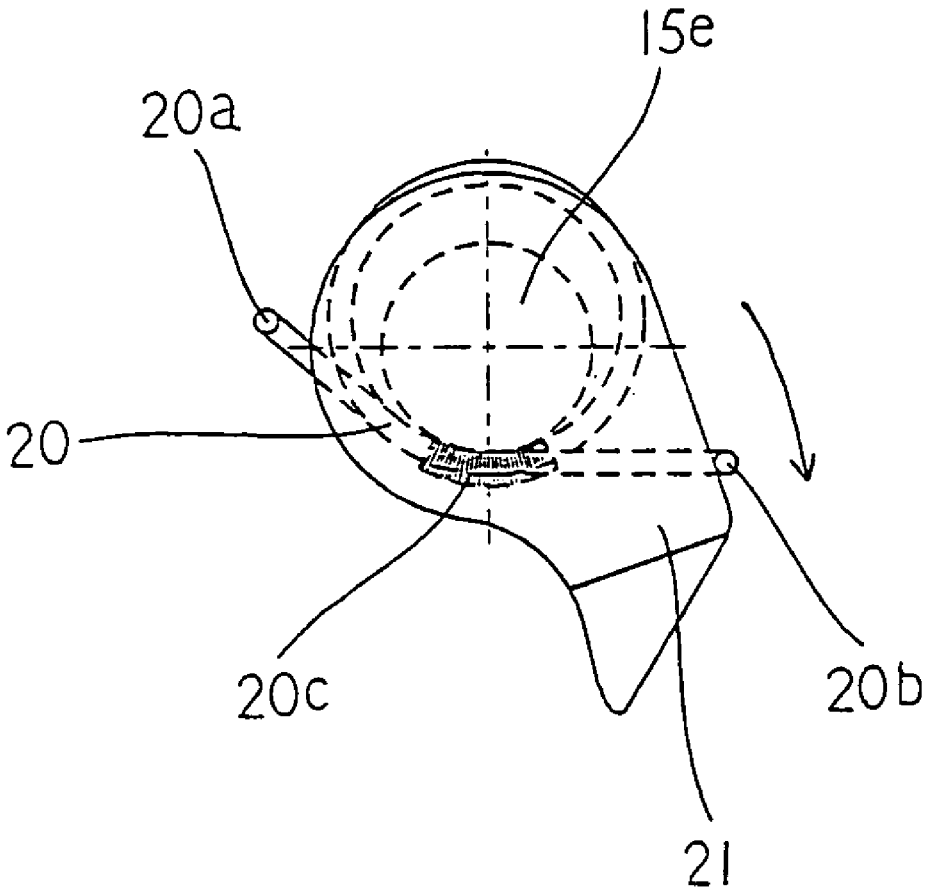
FIG. 19 is an enlarged, front view showing the reverse-rotation preventive pawl.
Figure 20:
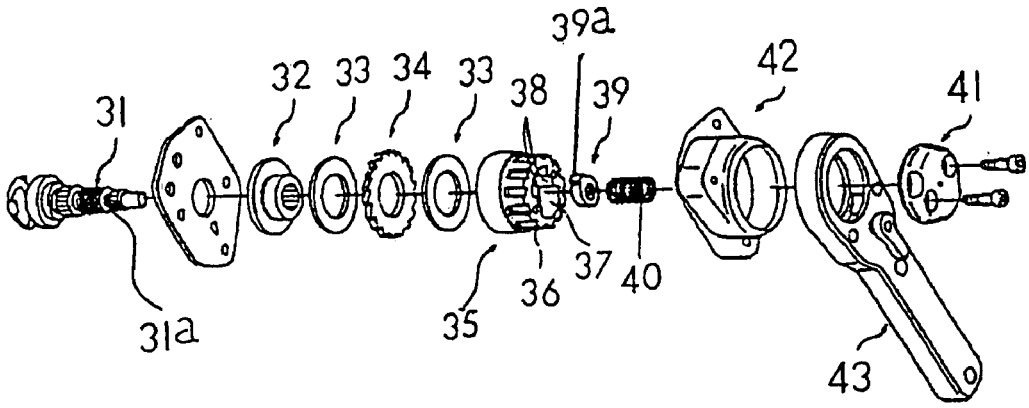
Fig. 20 (PRIOR ART)
FIG. 20 is a schematic view showing prior art corresponding to the first embodiment.
Figure 21:
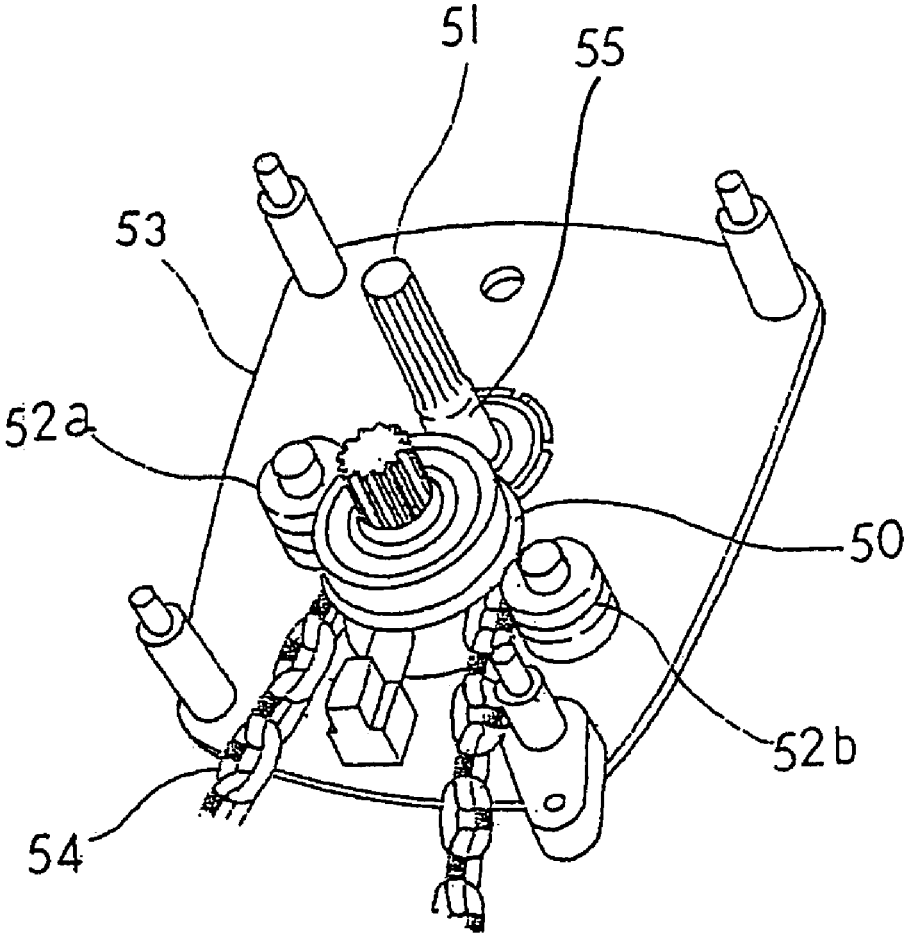
Fig. 21 (PRIOR ART)
FIG. 21 is a schematic view showing prior art corresponding to the second embodiment.
Figure 24:
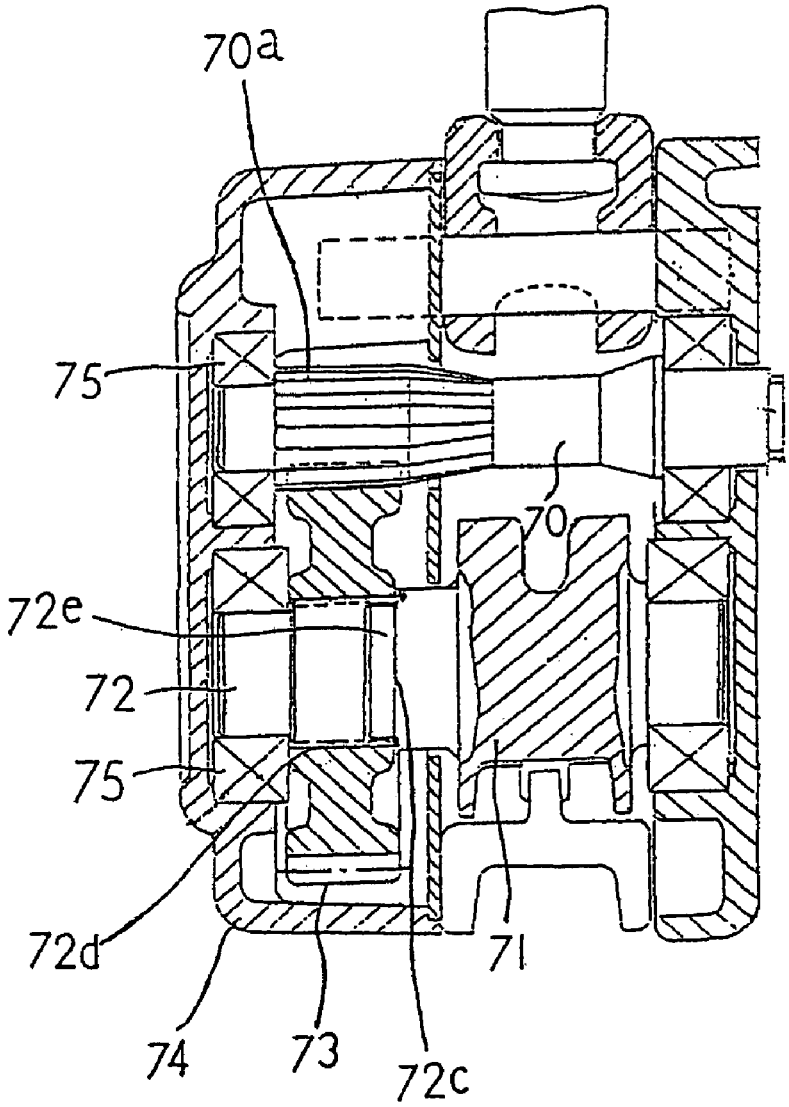
Fig. 24 (PRIOR ART)
FIG. 24 is a side view showing prior art corresponding to the fourth embodiment.
Figure 25:
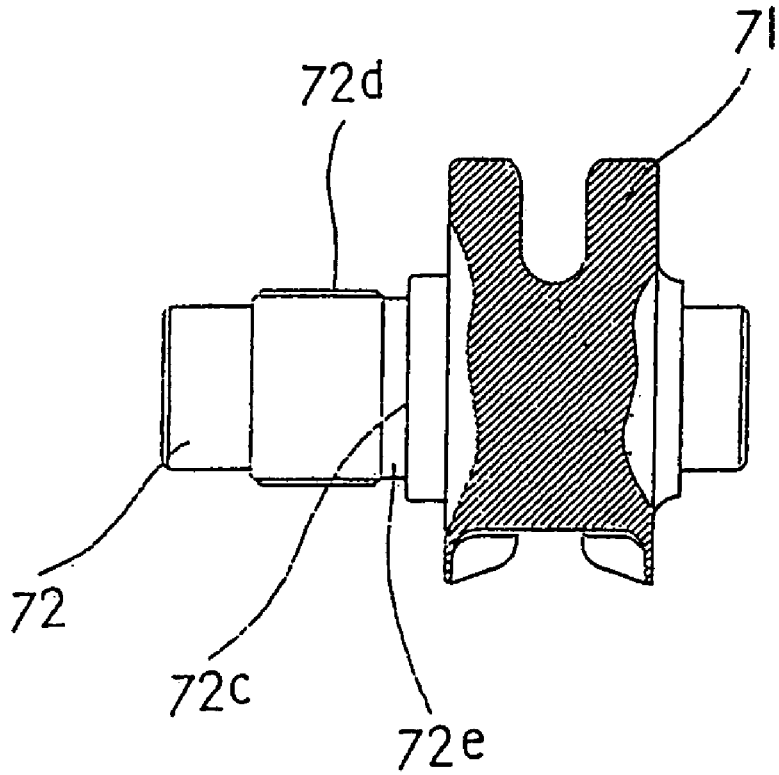
Fig. 25 (PRIOR ART)
FIG. 25 is a side view showing a load sheave and a load gear in FIG. 24.
Figure 26:
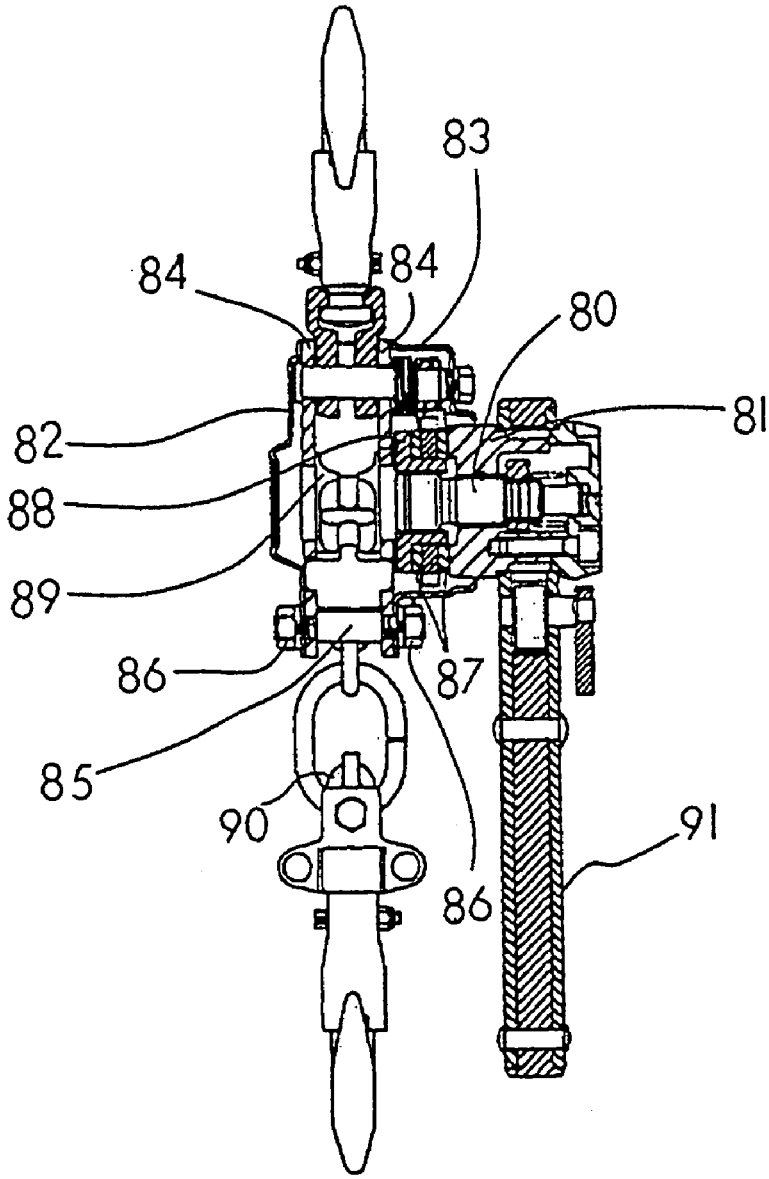
Fig. 26 (PRIOR ART)
FIG. 26 is a schematic view showing prior art of a winching and drawing machine corresponding to the fifth embodiment.

Reference numeral 15*e* denotes a spring wound portion provided contiguous to small-diameter portions 15*d* of hollow spacer 15*b*, which may be the same in diameter as, or smaller, than that of the small-diameter portions 15*d*. Reference numeral 15*i* denotes a pawl mount portion, on which pawl 21 is mounted, and which may be smaller in diameter than, or the same as, that of the spring wound portion 15*e*. Reference numeral 15*h* denotes a flange provided between the spring wound portion 15*e* and the pawl mounted portion 15*i* to restrict movement of spring 20 toward the pawl 21. Reference numeral 21 denotes a reverse-rotation preventive pawl mounted on the pawl mounted portion 15*i* of hollow spacer 15*a*, 20 the spring comprising, as shown in FIG. 19, a frame-side latch portion 20*a* being latched on frame 17*b* and a pawl-side latch portion 20*b* to span over the flange 15*h* to be latched on the reverse-rotation preventive pawl 21 and bias the reverse-rotation preventive pawl 21 clockwise in this figure, with the spring being mounted on the spring winding portion 15*e* of the hollow spacer 15*a*.

Figure 16:
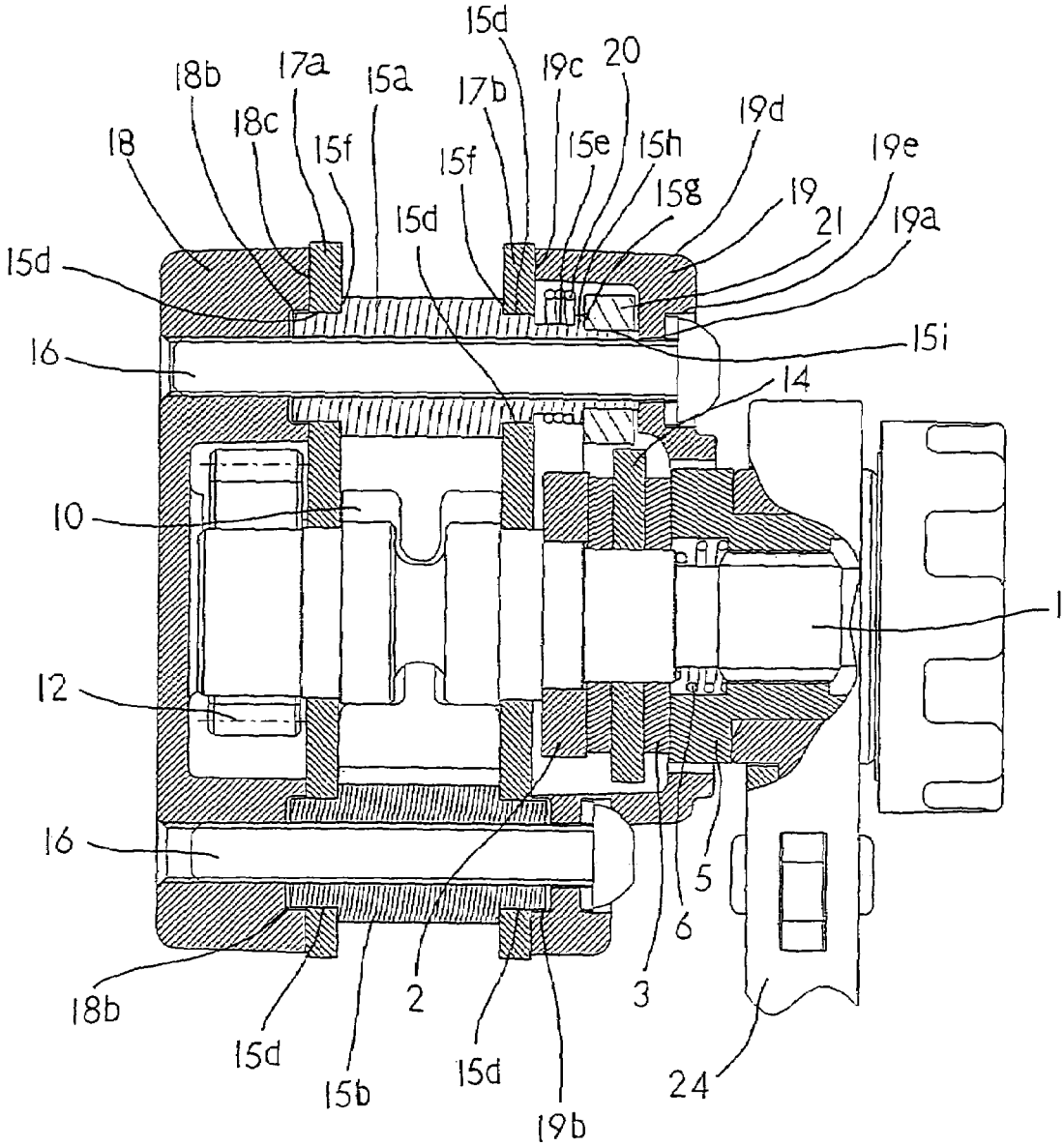
FIG. 16 is an enlarged, side view showing a sixth embodiment of the invention.

According to this embodiment, since the flange 15*h* is provided between the spring wound portion 15*e* of the hollow spacer 15*a* and the pawl mounted portion 15*i* on which the reverse-rotation preventive pawl 21 is mounted, movement of the spring 20 toward the reverse-rotation preventive pawl 21 is restricted and the spring 20 can be prevented from falling on the pawl mounted portion 15*i* at a time of assembling of the reverse-rotation preventive pawl 21, so that a retaining member is not needed and the hollow spacer 15*a* can be caused to abut directly brake cover 19 to restrict the reverse-rotation preventive pawl as shown in FIG. 16, thereby enabling a winching and drawing machine to be easily assembled.

Figure 17:
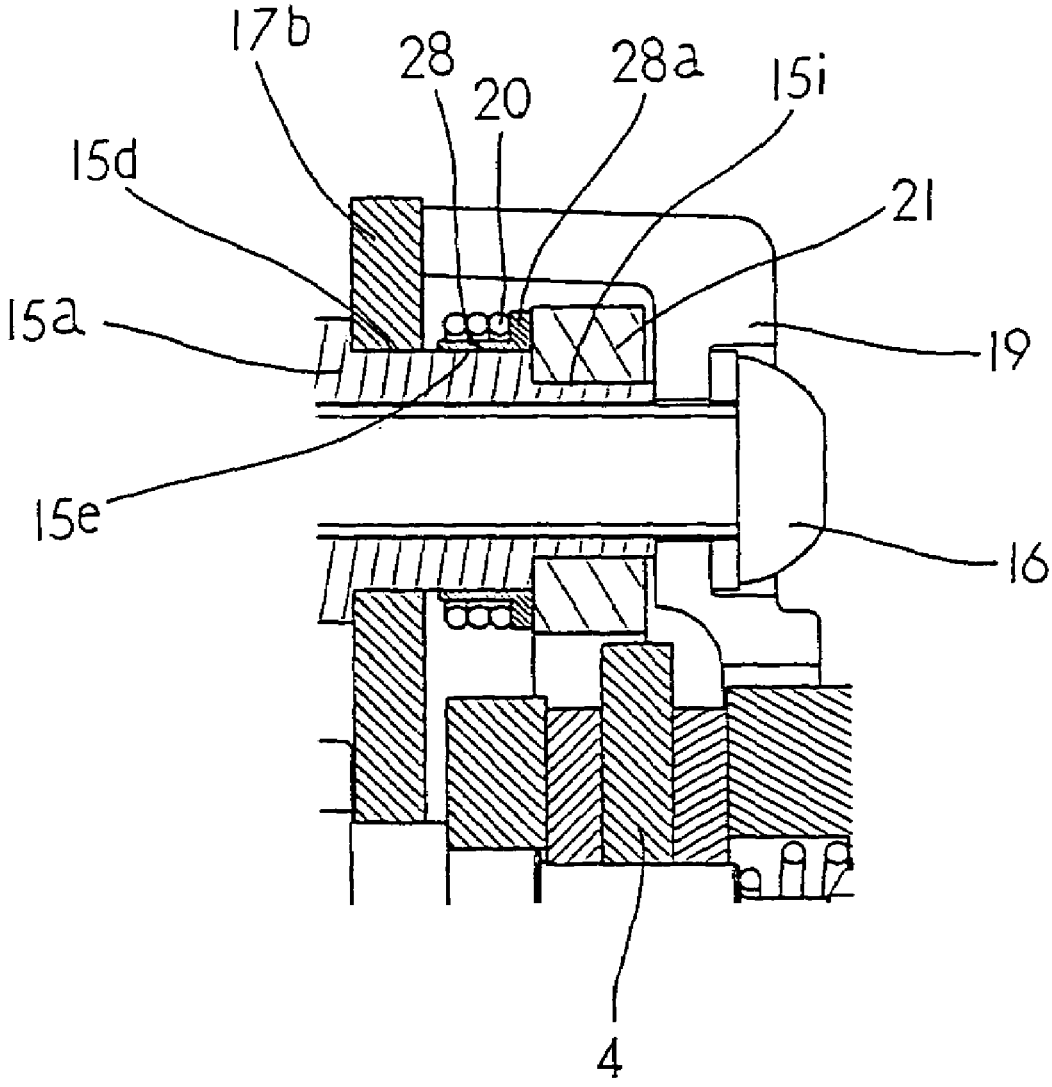
FIG. 17 is an enlarged, side view showing a spring and a reverse-rotation preventive pawl in a brake device.

In FIG. 17, a spring holding member 28 having a flange 28*a* on a side toward the reverse-rotation preventive pawl 21 is fixed on the spring wound portion 15*e*, and the spring 20 is mounted on the spring holding member 28 to bias the reverse-rotation preventive pawl 21. In this embodiment, since the flange 28*a* restricts movement of the spring 20 toward the reverse-rotation preventive pawl 21 in the same manner as in the preceding embodiment, a retaining member is not needed at a time of assembling and the hollow spacer 15*a* can be caused to abut directly the brake cover 19 to restrict the reverse-rotation preventive pawl 21.

Figure 18:
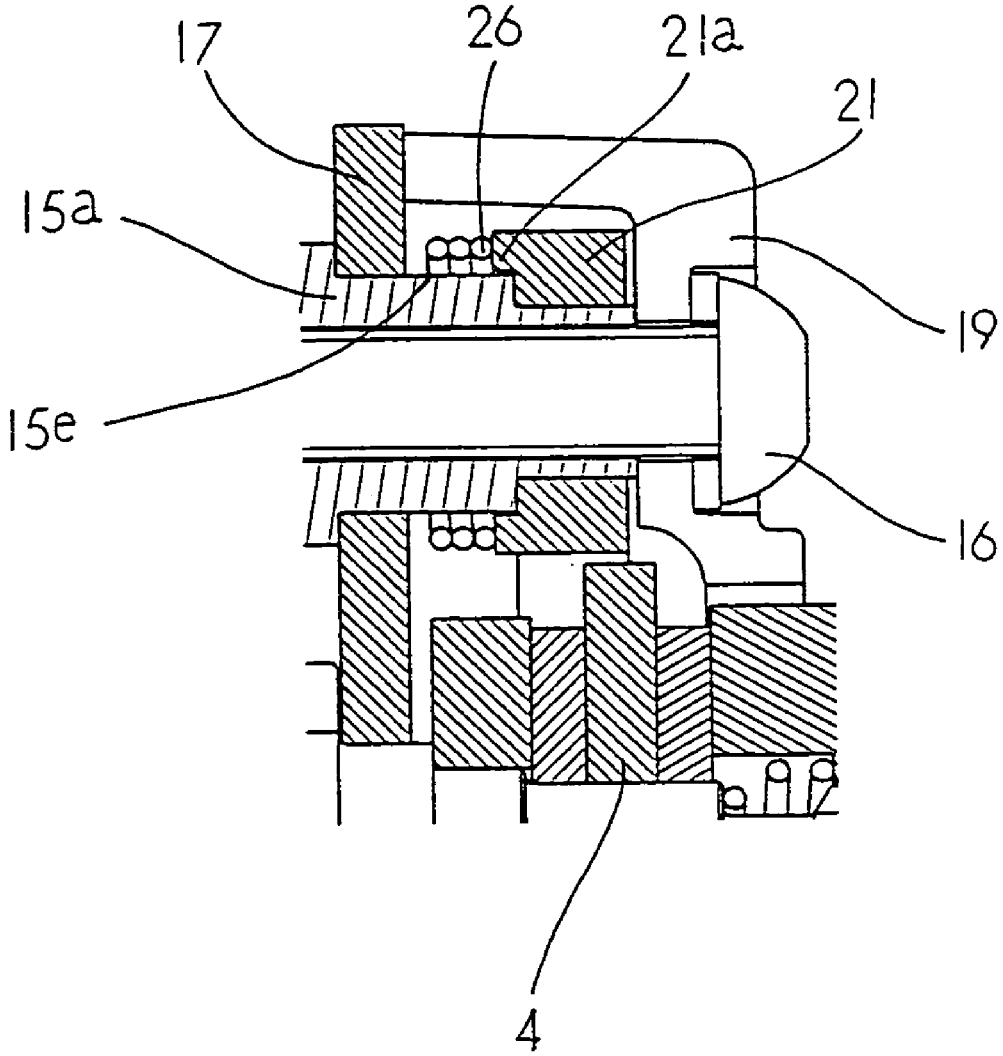
FIG. 18 is an enlarged, side view showing another embodiment of the spring and the reverse-rotation preventive pawl in the brake device.

In FIG. 18, a projection 21*a* is provided on the reverse-rotation preventive pawl 21 to project toward the spring wound portion 15*e* and abut a side of the spring 20, and movement of the spring 20 toward the reverse-rotation preventive pawl 21 is restricted by the projection 21*a*. Like the preceding embodiment, movement of the spring 20 toward the reverse-rotation preventive pawl 21 is restricted, so that a retaining member is not needed at the time of assembling and the hollow spacer 15*a* can be mounted directly on the brake cover 19 to restrict the reverse-rotation preventive pawl 21.

In addition, the projection 21*a* is not limited to a configuration shown in FIG. 18, and instead of abutting the side of the spring 20, the projection 21*a* can be also inserted between the spring wound portion 15*e* and the spring to restrict movement of the spring 20 toward the reverse-rotation preventive pawl 21.

FIG. 19 is a side view showing a state, in which the spring 20 is mounted. In FIG. 19, reference numeral 20*a* denotes the frame-side latch portion of the spring at which the spring 20 is latched on the frame 17*b*, 20*b* the pawl-side latch portion at which the spring, is latched on the reverse-rotation preventive pawl 21, and the reverse-rotation preventive pawl 21 is biased in a direction indicated by an arrow, that is, clockwise by the spring 20 as shown in FIG. 19. When the spring 20 biases the reverse-rotation preventive pawl 21 in a direction indicated by the arrow, a reaction force to biasing action of the spring exerts a force which causes a spring winding portion 20*c* extended from the pawl-side latch portion 20*b* of the spring 20 to elastically react toward the spring wound portion 15*e*, so that the spring winding portion 20*c* is pushed toward the spring wound portion 15*e* and a remaining portion expands upward in FIG. 19, that is, in a direction over and away from the flange 15*h* or flanges 28*a*, 21*a*. Accordingly, it suffices that the flanges 15*h*, 28*a*, 21*a* be shaped to restrict only the spring winding portion 20*c*. By shaping the flanges 15*h*, or 28*a*, 21*a* in a manner to restrict only the spring winding portion 20*c*, the flanges can be made lightweight.

In addition, while this embodiment has been described with respect to a configuration with use of hollow flanges, it is not limited to the hollow flanges but it suffices that a shaft body can be mounted with a spring to bias the reverse-rotation preventive pawl.

The invention can provide a winching and drawing machine in which a spacing of body frames of the winching and drawing machine is determined by steps of hollow spacers, the frames are positioned, and by clamping bolts, the frames are clamped and fixed between steps provided on the spacers and inner end surfaces of a gear casing and brake cover to facilitate positioning of the frames and eliminate dislocation such as offset between the frames and remaining parts, and which is solid, small in size, lightweight, compact, and easy to assemble and disassemble. Further, the invention can provide a winching and drawing machine, in which a restriction member such as a flange is provided between a spring wound portion and a pawl mounted portion on the spacers to restrict movement of the spring toward a pawl, thereby preventing the spring from falling on the pawl mounted portion at a time of assembling of the pawl, whereby a retaining member is not needed as in conventional devices and the spacers can be mounted directly on the brake cover to restrict the pawl, and which is easy to assemble.

INDUSTRIAL APPLICABILITY

As described above in detail, while a restriction member for restriction of rotation of a drive member is necessary in conventional winching and drawing machines provided with an idler grip, according to the present invention, a stopper structured in the manner described above is provided to make unnecessary any restriction member, a construction in which the idler grip is not fixed to a drive member is provided which makes it unnecessary to make the drive member large in diameter and makes it possible to make a winching and drawing machine small in size and lightweight, and an end face of a handle mount on the winching and drawing machine is covered by the idler grip, whereby the winching and drawing machine can be more gracefully shaped than conventional winching and drawing machines.

Further, as compared with a conventional arrangement, in which washers for prevention of a drive member and a handle from coming off are provided at an end of a drive shaft, a winching and drawing machine having multiple functions can be provided because it is possible to adjust a chain length with an idler grip. Further, according to the invention, by making a mount portion of an idler spring on a side of brake plates small in diameter as compared with the mount portion on a side of the drive member, and mounting the small-diameter portion on a latch portion provided on the mount portion by the brake plates, the drive shaft can be made small in diameter as compared with conventional winching and drawing machines, and parts mounted on the drive shaft can be also made small in diameter, so that it is possible to provide a winching and drawing machine, which can be made small in size, lightweight and inexpensive. Further, according to the invention, since a guide roller is provided coaxial with the drive shaft, it is possible to provide a winching and drawing machine, in which a number of parts can be decreased, a body of the winching and drawing machine can be made small in size and lightweight, and assembling steps are decreased to lead to a decrease in cost as compared with conventional winching and drawing machines in which guide rollers are borne as separate parts by frames. Further, when a winching-down action of a link chain is performed, transverse links of the chain forwarded onto a chain guide are restricted from inclining by a slope of a inner guide, a vertical link forwarded onto the chain guide subsequent to a transverse link is also restricted in inclination, and vertical links are fitted into a groove of an outer guide to be forwarded so as to assume a cross pattern with the transverse links, so that the link chain is not caught by the outer guide, the winching-down operation can be smoothly performed, and further grooves in place of conventional splines are provided on a sheave shaft and a load gear is fittingly mounted on the grooves, whereby no relief space for working on the sheave shaft is needed and the machine in its entirety can be made small in size, lightweight, and low in cost. Since the grooves are provided with slopes which are inclined toward an axis of the sheave shaft, a direction of torque transmission is made circumferential, torque transmission can be smoothly effected, and load on the sheave shaft can be lessened, so that it is possible to reduce a number of grooves, or make the grooves small in configuration, which extremely facilitates working. It is possible to provide a compact and precise winching and drawing machine, in which a spacing of body frames of the winching and drawing machine is prescribed by steps of spacers, the frames are easily positioned when clamping is effected by bolts between the steps provided on the spacers and inner end surfaces of a gear casing and a brake cover, and when the frames are clamped, there are no clearances between parts, and dislocation such as offset is not generated between the frames and remaining parts.

The invention claimed is:

1. A winching and drawing machine comprising:

a pressure receiving member mounted on a drive shaft;

two brake plates, contiguous to said pressure receiving member, mounted on said drive shaft;

a pawl wheel between said two brake plates;

a drive member screwed onto said drive shaft to come into pressure contact with, and separate from, said two brake plates;

a load sheave;

a load gear;

two frames that support said load sheave;

a gear cover on one of said two frames and covering said load gear;

a brake cover on the other of said two frames and covering said two brake plates; and spacers between said gear cover and said brake cover to abut said two frames, with one of said spacers having a spring wound portion on which a spring is mounted, a pawl mount portion on which is mounted a reverse-rotation preventive pawl that is to be biased by said spring, and a restriction member between said spring wound portion and said pawl mount portion to restrict movement of said spring toward said reverse-rotation preventive pawl, wherein one end of said spring is latched onto one of said two frames, and another end of said spring is latched onto said reverse-rotation preventive pawl, and wherein rotation of said drive member is to be transmitted, via said two brake plates, reduction gears, and said load gear, to said load sheave so as to rotate said load sheave.

2. The winching and drawing machine according to claim 1, wherein said restriction member comprises a flange on said spring wound portion.

3. The winching and drawing machine according to claim 1, wherein said restriction member comprises a flange on a spring holding member that is positioned outside said spring wound portion.

* * * * *